US010480275B2

(12) United States Patent
Vander Velde et al.

(10) Patent No.: US 10,480,275 B2
(45) Date of Patent: Nov. 19, 2019

(54) COILED TUBING SPIRAL VENTURI TOOL

(71) Applicant: OIL & GAS TECH ENTERPRISES C.V., Belleville (BB)

(72) Inventors: Scott Vander Velde, Calgary (CA); Richard Castellano, El Tigre (VE); Andrés Oliveros, El Tigre (VE); Miguel Ochoa, El Tigre (VE)

(73) Assignee: OIL & GAS TECH ENTERPRISES C.V., Belleville (BB)

( * ) Notice: Subject to any disclaimer, the term of this patent is extended or adjusted under 35 U.S.C. 154(b) by 212 days.

(21) Appl. No.: 15/638,184

(22) Filed: Jun. 29, 2017

(65) Prior Publication Data

US 2018/0010416 A1 Jan. 11, 2018

Related U.S. Application Data

(60) Provisional application No. 62/358,947, filed on Jul. 6, 2016.

(51) Int. Cl.

| | |
|---|---|
| ***E21B 37/04*** | (2006.01) |
| ***E21B 33/12*** | (2006.01) |
| ***E21B 23/06*** | (2006.01) |
| ***E21B 41/00*** | (2006.01) |
| ***E21B 10/18*** | (2006.01) |
| *E21B 33/127* | (2006.01) |

(52) U.S. Cl.

CPC ..... *E21B 33/1208* (2013.01); *E21B 10/18* (2013.01); *E21B 23/06* (2013.01); *E21B 37/04* (2013.01); *E21B 41/0078* (2013.01); *E21B 33/1272* (2013.01)

(58) Field of Classification Search

CPC ..... E21B 37/00

See application file for complete search history.

(56) References Cited

U.S. PATENT DOCUMENTS

| | | | | |
|---|---|---|---|---|
| 4,088,191 | A * | 5/1978 | Hutchison | E21B 37/00 166/223 |
| 5,086,842 | A * | 2/1992 | Cholet | B05B 1/267 134/167 C |
| 5,280,825 | A * | 1/1994 | Cholet | E21B 21/12 166/311 |

(Continued)

FOREIGN PATENT DOCUMENTS

| | | |
|---|---|---|
| WO | 2016/205956 | 12/2016 |

*Primary Examiner* — William D Hutton, Jr.
*Assistant Examiner* — Steven A MacDonald
(74) *Attorney, Agent, or Firm* — Davis Wright Tremaine LLP; Heather M. Colburn

(57) ABSTRACT

A tool and method to remove sand and other types of solid particulate materials and fluids from wellbores and conduits, resulting from well-drilling, well-production or both, and consequently to reactivate well production. The modular tool, composed of different subsystems, is connected to the end of concentric coil tubing, operates promoting the aggregates disintegration by using a spiral jet to impact these solids and suctioning the small particles and well fluids, simultaneously or later, by using jet pumps based on a set of several venturis. Changes between different operation modes are imposed by modifying surface pump pressure levels and the tool does not need to be removed from the wellbore between different stages, reducing the overall operation time.

25 Claims, 29 Drawing Sheets

(56) References Cited

U.S. PATENT DOCUMENTS

| | | | | |
|---|---|---|---|---|
| 6,453,996 | B1 * | 9/2002 | Carmichael | E21B 37/00 166/177.3 |
| 2012/0132289 | A1 * | 5/2012 | Kolle | E21B 21/10 137/14 |
| 2018/0283118 | A1 * | 10/2018 | Vander Velde | E21B 27/00 |

* cited by examiner

COILED TUBING SPIRAL VENTURI TOOL

CROSS REFERENCE TO RELATED APPLICATION(S)

This application claims the benefit of U.S. Provisional Application No. 62/358,947, filed on Jul. 6, 2016, which is incorporated herein by reference in its entirety.

TECHNICAL FIELD

This disclosure relates to maintenance and cleaning of oil field and gas field wellbores. More specifically, this disclosure pertains to coiled tubing equipment and tools used for cleaning sand and other types of particulate materials out of wellbores.

BACKGROUND

Concentric coil tubing, also commonly referred to as "endless tubing", is widely used in the oil and gas service industries for conducting many different stimulation and or work-overs of newly drilled and older producing wells. Coil tubing generally comprises a continuously "spooled" indefinite length of tubing, usually constructed of steel although other materials have been used.

Oil/gas service tools are commonly connected to a coiled tubing unit and inserted into wellbores for downhole cleaning or formation stimulation. Examples of such tools include wash nozzles and jetting nozzles. For example, a wash nozzle connected to the end of coiled tubing is inserted into a wellbore after which, a pressurized cleaning fluid exemplified by water, acids or nitrogen, and the like, is pumped into the coil tubing and exits through the wash nozzle in the vicinity of the area to be cleaned. Such wash nozzles are commonly used to remove sand plugs, wax, calcium or debris such as failed linings from within the coiled tubing unit. Accumulations of sand plugs and/or wax and/or calcium, and/or debris significantly reduce the well performance. Similarly, wash nozzles can be used to clean other confined and/or tubular spaces exemplified by sewer lines, industrial waste lines, and the like.

Existing jetting tools may have static or moveable jetting nozzles. The first are more simple but its performance is limited to the areas of the conduit where the nozzle jet is directed, while the moveable nozzles have the advantage of sweeping the circumference of the tool but have a lower reliability due to the failure in moveable parts in contact with the well fluids and solids or even conduit surface, and the difficulties in the control of the nozzles spinning which causes the loss of energy of the jet. Some other jetting tools use alternatives to address these difficulties but result in a higher risk to the formation.

An emerging jetting nozzle technology called Vortex Generating Washer Nozzles (PCT/CA2016/050751) uses an innovative system consisting on static nozzles which generate spiral currents thanks to a high-speed pulsatile and intermittent fluid flow covering a 360 degrees sweep of the circumference of the conduit.

Downhole jet pumping is a common oil/gas process used to extract fluids inside the wellbore up to the surface, by means of the injection of a pressurized external fluid which passes through a venturi nozzle, creating a pressure drop at the venturi throat which sucks the wellbore fluids and to later pump them up to the surface.

Existing coiled tubing servicing tools in the oil/gas have tested the effectiveness of the methods separately, by means of specialized tools for specific conditions of the wells or ducts, but with a lack of flexibility to be used in different well conditions, and with a poor integration between the two operating principles, making necessary having several specialized tools to satisfy the demand for services in fields having wells with different conditions, from depth and wellbore fluid pressure to different density and viscosity fluids.

SUMMARY

The invention relates to the cleaning and removal of liquids and/or solids in a wellbore or conduits that may be obstructing well flow and tools entrance. Examples of which are sand, mud, small rock particles, scale, wax, and water which are results of well-drilling, well-production operations or both. These are typical production problems encountered with all wells whether drilled vertically, horizontally or, deviated, or a combination of.

Applications of the invention relates to proven technologies and techniques for removal of particles otherwise obstructing well flow.

Conventional methods for removing these obstructions may include, but are not limited to bailing, high pressure fluidizing, drilling, milling, and acidizing. However, the uses of some of these methods are not desirable as further damage to the well formation may be a result.

The objectives of this invention include but are not limited to:

1) Provide a simple and effective tool and method based on proven technologies to remove obstructions in wellbores and conduits that limit: (a) expected flow of fluids through the well or conduit; (b) tool entrance into the wellbore; and (c) flow of formation fluids flow into the wellbore in the case of oil and gas wells.

2) Provide a simple and effective tool and method for recovering well fluids and solids to reactivate well production non harmful for the formation 3) Provide a single, compact and modular tool able to be adapted to wells of different conditions by means of few hardware changes, mainly referring to different composition and properties of obstructing solids, different well fluid density and viscosity and different depth, pressure and directionality of the wells.

4) Provide a simple and effective tool and method to accomplish the preceding tasks listed in objectives (1) and (2) using the same Bottom Hole Tool Assembly without removing it from the wellbore between tasks.

5) Provide a tool or method that guarantees a prolonged life of the key components.

6) Provide a tool and method that reduces the overall operation time when operating in the well or conduit 7) Provide a tool with a highly reliable operation To accomplish these objectives, it is disclosed a Coiled Tubing Spiral Venturi Tool (CTSVT) which is a modular, compact tool assembly (also known as a Bottom Hole Assembly BHA), easily attachable to a concentric coiled tubing system, comprising basically a jet pump system or suction head, a jetting washing nozzle subsystem and a flow control subsystem, arranged in an innovative architecture that allows cleaning and removal of solid obstructions in wells and conduits as well as the reactivation of the production in oil and gas wells by means of the individual or simultaneous use of the jetting washing functions and the jet pumping function.

The present invention is exemplified by a preferred embodiment of the tool assembly, with the components that better accomplish the stated objectives. However, as one of the objectives of this invention relates to easy adaptation to wells with different conditions it is also disclosed alternative embodiments of the tool to satisfy those conditions. The adaptability of the tool refers to the mechanical adjustment of specific control components and to the replacement, addition or removal of some specific purpose modules.

The architecture of the tool from a functional perspective is composed of: (a) a jetting nozzle subsystem, which is located on the lower side of the tool and consists on a modular jetting nozzle assembly based on the Vortex Generating Washer Nozzle principle (PCT/CA2016/050751) or variations of it; (b) a jet pump subsystem or suction head located at the upper side of the tool with respect to the jetting nozzle subsystem, consisting of a modular hollow disc shaped arrangement of several venturis peripherally located on those discs around a central conduct (to allow the flow of the power fluid to the other conduits of the tool), and (c) a control subsystem which is located along the flow path of the power fluid, on the center conduct of the tool, consisting on an innovative series of pressure sensitive valves that block and divert the power fluid depending on its pressure level. The upper and lower directions refer to the part of the tool located closer to the surface or more distant from it respectively.

The Coiled Tubing Spiral Venturi Tool is a hydraulically operated device using one or more hydraulic conduits where one or all of them are concentrically assembled in relation to each other to supply a high pressure power fluid to the Bottom Hole Assembly (BHA). The high pressure power fluid is pumped from a surface pressure unit down to the BHA through the internal conduct of concentric coiled tubing, and is then utilized to:

a) Supply high pressure fluid to one or several jetting nozzle directed towards solid obstructions in the wellbore, breaking it down into smaller removable particles thereby unplugging the wellbore fluid flow.

b) Supply high pressure fluid to a venturi assembly using jet pump principles to suction wellbore fluid and/or carried solids into the tool and then pressurize them to pump them up to the surface through the annular conduct of the coiled tubing.

c) Remotely select whether to direct the high pressure fluid: to the jetting nozzles, to the jet pump, both at the same time or neither of them by means of the control subsystem valves activated by different pressure levels on the power fluid.

The control subsystem is composed first by: (a) a hold down valve located upstream at the entrance of the power fluid to the tool, being a two position pressure sensitive valve in charge of stopping or allowing the flow into the tool; (b) a control valve, located downstream of the hold down valve, being a three position pressure sensitive valve, diverting the power fluid flow into the jetting nozzle assembly exclusively (position normally closed), to both the jetting nozzle assembly and the jet pump assembly (intermediate position), or to the jet pump assembly exclusively (position completely retracted), respectively depending on the pressure of the power fluid it faces.

The four different positions of the two valves in addition to the possibility of movements upwards, downwards or no movement of the tool by the coiled tubing action, provide the tool with six differentiated operation modes, which can be activated in a continuous way once the tool is down into the wellbore without the requirement of taking the tool out to the surface, which can be combined in specific sequences providing effective methods to accomplish the solid removal and/or well stimulation within the same tool run into the well.

In order to accomplish one of the objectives of the present invention referring to provide a compact tool, most of the components mentioned belonging to different subsystems are arranged in a constructive way that some of them get enclosed or being shared by other subsystem. The exemplified tool in the later description of this disclosure shows a preferred embodiment of the tool with the control valve totally embedded within the jetting nozzle assembly, with some components providing multiple functionality on both subsystems. The compact architecture is important not only because of the saving in components, but also from the perspective that the shorter the overall tool length, the better adaptability to the shapes of the well including the solid obstructions.

In order to address the reliability objective of the device while running into the well two filtering systems are included, a common filter to all the embodiments of the device located in the jet pump suction of the wellbore fluid, and an alternative filter located at the entrance of the fluid power to the tool. Both filters prevent the flow ducts specially the smaller like nozzles from being clogged, limiting the operability of the tool. To increase tool reliability the system is also provided with a relief valve to ensure the proper seating of the control valve when different operation modes are set by means of changes in pressure of the power fluid. Other aspect of the operational reliability of the tool is aimed by the low number of components and the absence of relative movements between components.

One of the main advantages of the present invention respect to other existing tools lays on the ability to easily adapt a single tool to the changing conditions found among wells, especially to those referring to high changes on the wellbore and formation fluid density and viscosity, types of obstructing solids and service to be provided (cleanout or well activation) which some well service providers can find in the same geographical area. This tool adaptability is achieved by means of the replacement, addition or removal of some specific purpose modules like different venturi arrangement in size, shape and number; adjustable mechanics to allow different operating pressure switching levels; mechanical compensation of suction pressure versus pumping pressure; easily exchangeable different geometry valve modules to change tool behaviour favoring jetting over suctioning or vice versa; a rupture mechanism to aid to release the tool in case of sediment stuck; internal and external filtering modules to avoid entrance of certain size solids into the tool with its respective downhole cleaning methods. Every addition or adaptation of the preferred embodiment of the tool with the mentioned modules is presented as a disclosed alternative embodiment of the present invention.

The device utilizes materials specifically selected to provide longevity against damage incurred by removing the obstructive materials from the wellbore.

The exemplary embodiments of the present disclosure pertain to coiled tubing spiral venturi tools for cleaning and maintenance of oil-field wellbores and/or gas field wellbores.

BRIEF DESCRIPTION OF THE FIGURES

The present disclosure will be described in conjunction with reference to the following drawings in which.

DETAILED DESCRIPTION

Figure 1A:
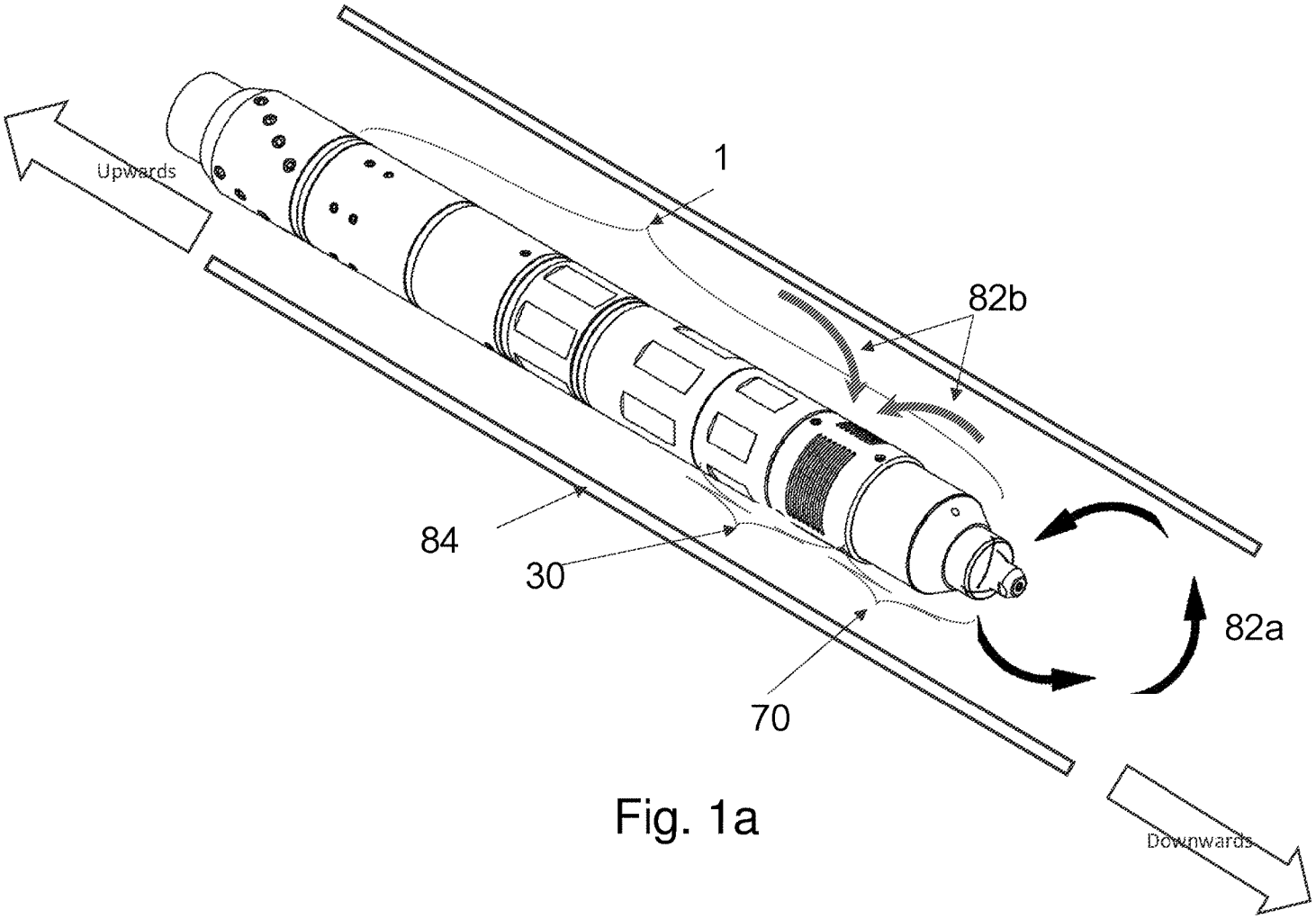
FIG. 1*a* is an isometric view of the assembled preferred embodiment of the coiled tubing spiral venturi tool indicating with schematic arrows the jetting flow, suctioning flow lines and tool orientation in the well.

The exemplary embodiments of the present disclosure pertain to a Coil Tubing Spiral Venturi Tool which is an attachable tool in concentric coil tubing systems, used to perform actions of removing and collecting restricting solids in conduits like oil well casings, gas well casings, production tubing, wellbores, industrial waste fluid lines, municipal waste fluid lines, and the like. The restricting solids may be depositional sediments, sand, mud, wax, scale, congregate, calcium and/or other types of debris from fluid-conveying conduits, which can represent total obstructions or plugins, like sand bridges or partial obstructions, limiting the normal flow of fluids through the conduit or well casing, reducing oil/gas well production, and increasing the risk for other coil tubing operations to be performed in such conduit or well.

The invention disclosed herein use the operating principle of induced spiral flow generated by a Vortex Generating Washing Nozzle system or variation thereof (PCT/CA2016/050751), combined with the vacuum suction and pumping power of an innovative multi venturi downhole jet pump, which can be operated remotely, individually or together, in order to better adapt to the obstruction condition and increase the spiral flow effect. The operative capacity of at least four modes of remote operation is achieved thanks to a combined system of pressure-sensitive valves.

The employment of Vortex Generating Washing Nozzles technology combined with the peripheral multi venturi suction capabilities make this invention advantageous over other existing tools employing similar physical principles in the matter of enhancing the solid obstruction removal effectiveness, as wells as the cost and time saving during coil tubing operations because of rapid responsiveness for changing modes of operation, the number of modes of operation available, and the tool ability to be adapted to different well conditions.

The preferred embodiment of the invention described herein with its component arrangement represents an improvement in operational reliability and component life with respect to the existing coil tubing cleanout tools using similar physical principles, and provides advantages related with the adaptability of the tool by replacement, addition or removal of modules to better respond to different well conditions, shown as alternative embodiments of the invention.

For the purpose of the present description, the terms Coil Tubing Spiral Venturi Tool Assembly (CTSVT) and Bottom Hole Assembly (BHA) are used indistinctly, referring to the same mechanical tool assembly herein disclosed identified with the number 1 in figures. The terms "Drive Fluid" and "Power Fluid" are used indistinctly and are identified in figures with number 81. The terms Jet Pump assembly and Venturi Assembly are used indistinctly. The terms Jetting Nozzle assembly, Washing nozzle assembly are used indistinctly, and refers to the Vortex Generating Washing Nozzle Assembly when referring to the preferred embodiment of the tool.

The exemplary assembly of the preferred embodiment of a Coiled Tubing Spiral Venturi Tool 1 according to the present disclosure is shown in FIGS. 1 to 14. The two basic functionalities of any embodiment of the assembled tool 1 while operating inside of a fluid conduit, wellbore or tubular casing 84 are shown in FIG. 1, being (a) jetting a power fluid to disintegrate solid deposits by means of direct impact of the power fluid jet or by inducing spiral current flow in the wellbore fluid represented by arrows 82*a*, which is performed by the Jetting nozzle subsystem 70, and (b) suctioning/pumping up the well fluids surrounding the tool represented by arrows 82*b* with the released solid particles suspended on it, performed by the suction head or jet pump subsystem 30. The tool can operate while moving downwards, upwards or while stationary at a fixed depth, with its axis oriented as the axis of the conduit. The tool is composed by multiple modular hollow disc shaped elements, aligned to specific positions that permit to connect internal fluid conduits. The external shape of the tool is cylindrical, with a smaller diameter than the conduit to allow the passage of fluids between the conduit walls and the tool, and to allow the tool 1 to move without friction into the conduit 84, and as big as possible to allocate the bigger venturi diffuser diameters, which are peripherally located around a central fluid conduit.

Figure 1B:
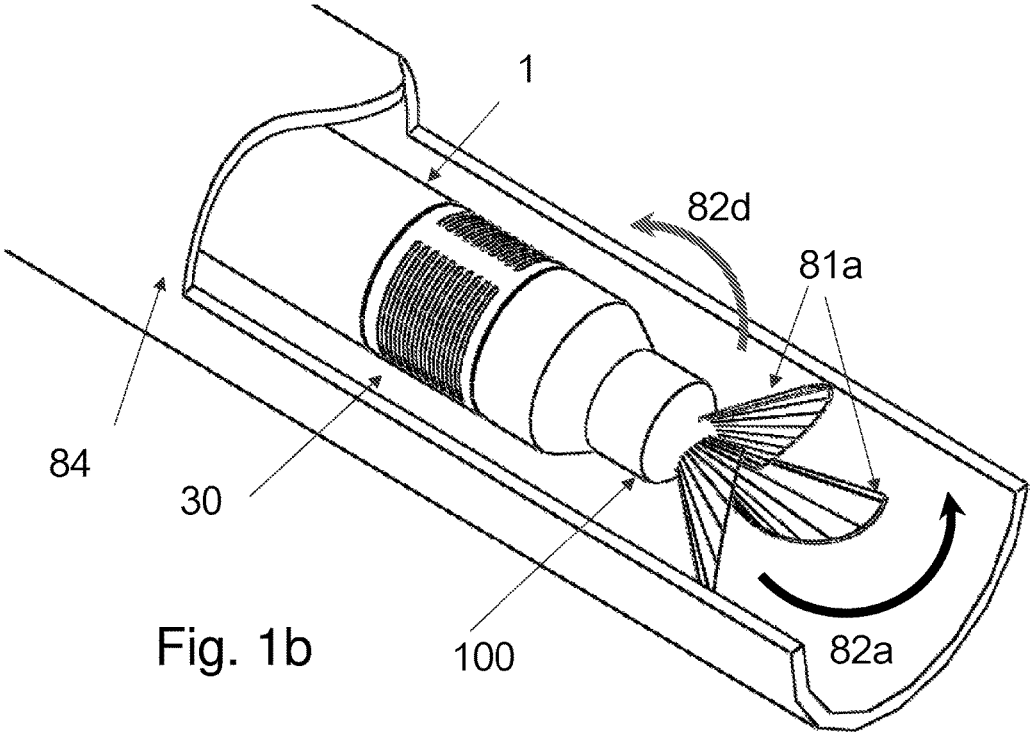
FIG. 1*b* is a partial isometric view of the assembled preferred embodiment of the Coiled Tubing Spiral Venturi Tool with the Vortex Generating Washing Nozzles Assembly placed inside of a sectioned conduit indicating the Spray Jetting and the spiral flow lines.
Figure 1C:
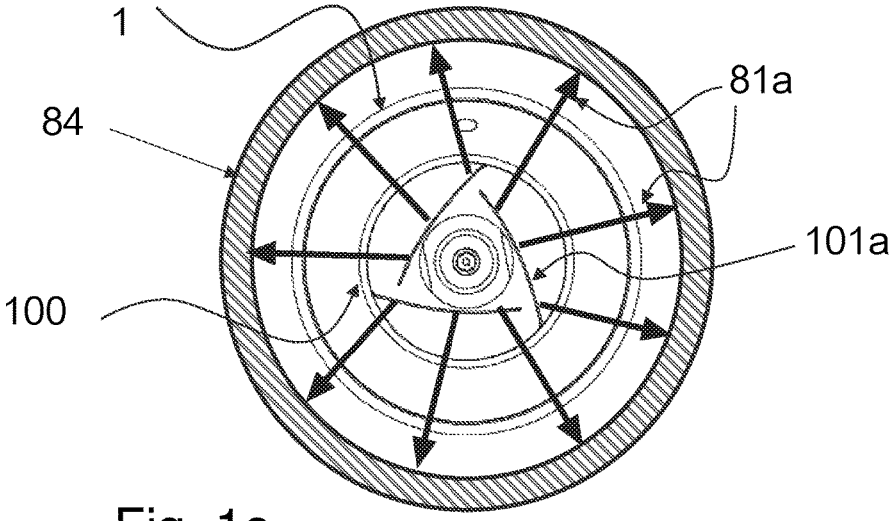
FIG. 1*c* is a cross section view of the conduit with a plan view of the preferred embodiment of the Coiled Tubing Spiral Venturi Tool with the Vortex Generating Washing Nozzles Assembly with arrows indicating Spray Jetting over internal conduit surface.

As stated above the Jetting Nozzle Subsystem 70 of the preferred embodiment uses the Vortex Generating Washing Nozzle (PCT/CA2016/050751) shown in FIGS. 1*b* and 1*c*, consisting on conical shaped pulsating sprays coming out of the slotted nozzles 101*a* located on the Vortex Generating Washing Nozzle assembly 100. FIG. 1*b* shows the Coiled Tubing Spiral Venturi Tool 1 inside of the conduit 84 which has been partially broken for illustration purposes with the power fluid 81*a* coming out of the tool in the form of three partial conical deployed spray of non-uniform height. The spray jet may produce the plugged or sediment solids removal on the internal conduit surface by direct impact or by means of spiral forward currents 82*a* in the wellbore fluids generated by the effect of said power fluid jet 81*a* The simultaneous effect of the spray jet of power fluid 81*a* with the active suction produced by the jet pump system 30 induces spiral upwards currents 82*d* on the well fluid. There are at least three slotted nozzles 101*a* which are elongated non-concentric slots, allowing the Power Fluid 81*a* to impact in a 360 degrees sweep over the internal surface of the conduit 84, represented by arrowed lines 81*a* in FIG. 1*c*. A plan view of the Coiled Tubing Spiral Venturi Tool 1 inside a crossed sectioned conduit 84 is shown in FIG. 1*c*, where it can be appreciated the distribution of the slotted nozzles 101*a*.

The physical principles behind the formation of the pulsating spray jet produced by the Vortex Generating Washing Nozzle (PCT/CA2016/050751) is out of the scope of this disclosure and is referred as a proven technology for this invention, being relevant for the present invention the innovative way how this assembly hardware interacts with the tool and the effects produced by the spray jet in conjunction with the particular use with this tool.

Figure 2:
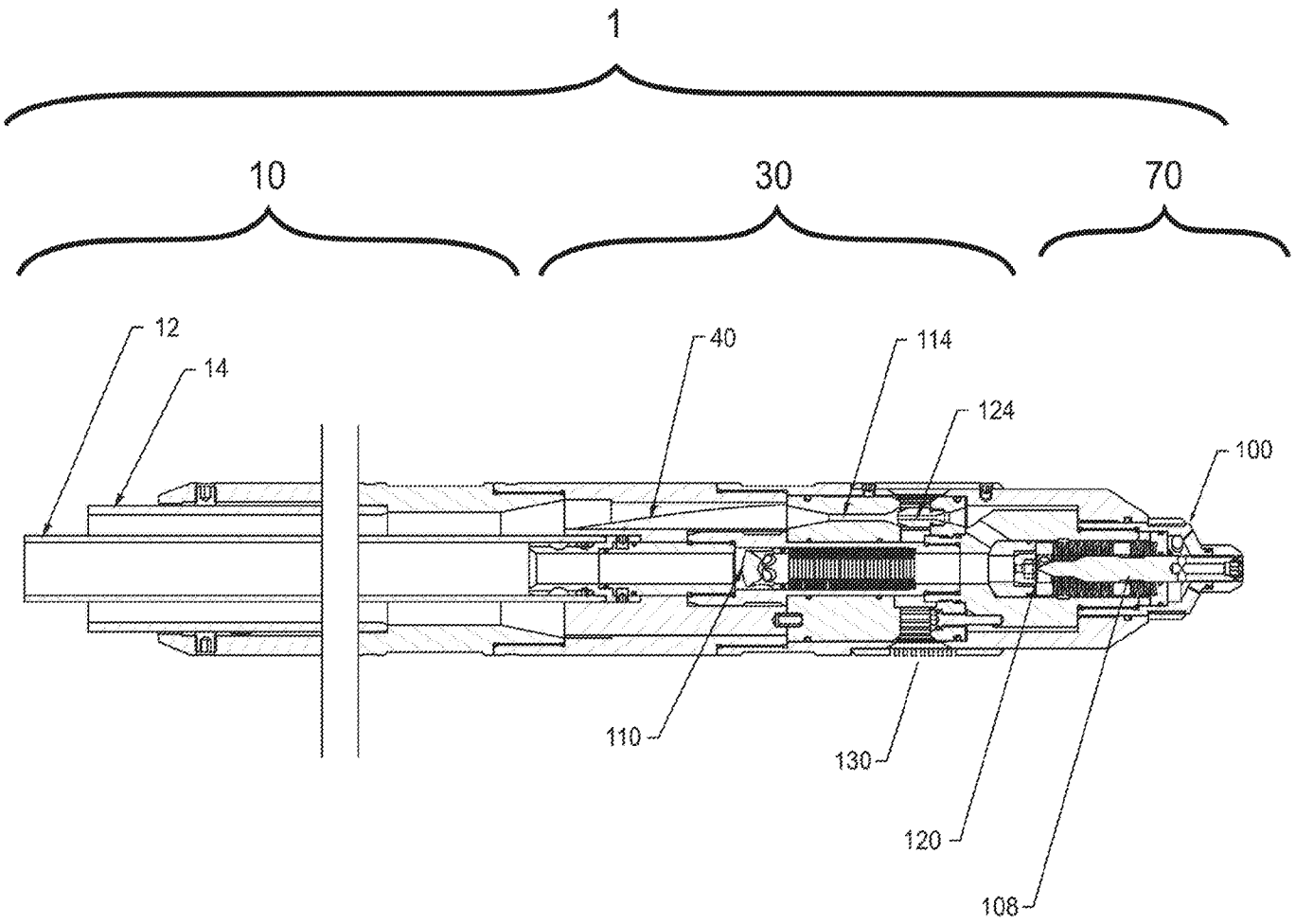
FIG. 2 is a longitudinal cross-section through one embodiment of a coiled tubing spiral venturi tool according to the present disclosure.

FIG. 2 shows a longitudinal section view of the preferred embodiment of the tool comprising a Concentric Connector Assembly 10, which connects the tool 1 with the coil tubing external conduit 14, the Venturi Plate Assembly 110, which center orifice serve as conduit for the pass of the power fluid being pumped from surface through the internal conduit of the coiled tubing 12, to later be diverted by the Control Valve Assembly 120 either to the jetting nozzles assembly 70, being finally jet sprayed out of the tool through the Vortex Generating Washing Nozzle assembly 100, or to be directed towards the suction head assembly 30 (FIGS. 2, 3) where the fluid is accelerated by the Venturi Nozzles 124 creating the pressure drop when passing through the convergent—divergent orifices of the Venturi Plate 114 which creates the suction of the wellbore fluids external to the tool through the slots in the Suction Head Housing 130. The wellbore fluids and the power fluid are mixed and pumped when passing through the Venturi Diffuser 40, and conducted to the surface as a return fluid through the annular conduit formed between the conduits 14 and 12 of the coiled tubing. The coiled tubing spiral venturi tool 1 is demountable and sealable, engage able with the concentric coiled tubing.

Figure 3:
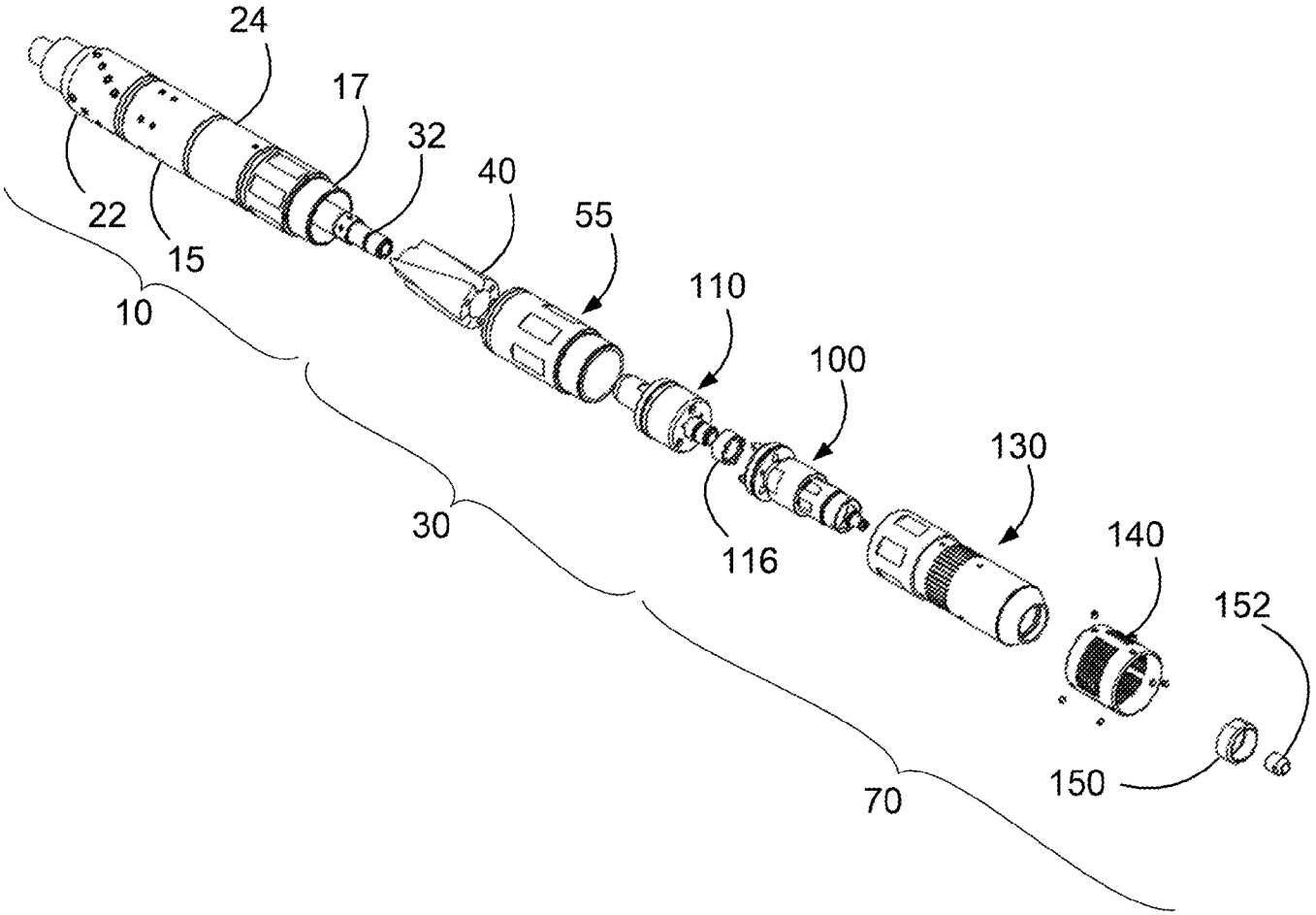
FIG. 3 is an exploded isometric view of the coiled tubing spiral venturi tool shown in FIG. 1.

FIG. 3 shows the easy assembly of hollow disc shaped components along to its axis of approximation. From top to bottom, first the Concentric Connector Assembly 10 is composed by the external connector top sub 22, the external connector component 15, external connector bottom sub 24 and external connector 17. Right in the bottom of it, it encounters, the Suction Head Assembly 30, composed by the Venturi Diffuser 40 and the Venturi Plate Assembly 110, enclosed into the Crossover Sub 55 and the Slotted Suction Head Housing 130 with is correspondent Suction Screen 140. All of the external longitudinal rectangular features as well as the small orifices located outside of the Concentric Connector Assembly 10 components and the Crossover Sub 55 are simply for exemplary purposes of features provided for wrenching and securing of the modular parts, being possible embodiments of the tools without any of those features. At the bottom of the tool it is located the Jetting Nozzle Subsystem 70 aligned with the suction Head Subsystem 30 by means of the Venturi Alignment Ring 116, and is composed by the Vortex Generating Wash Nozzle assembly 100, kept in place by the stop nut 150 and the valve stem lock nut 152 which secure the assembly with the thread of the jet shutoff valve stem.

Figure 4:
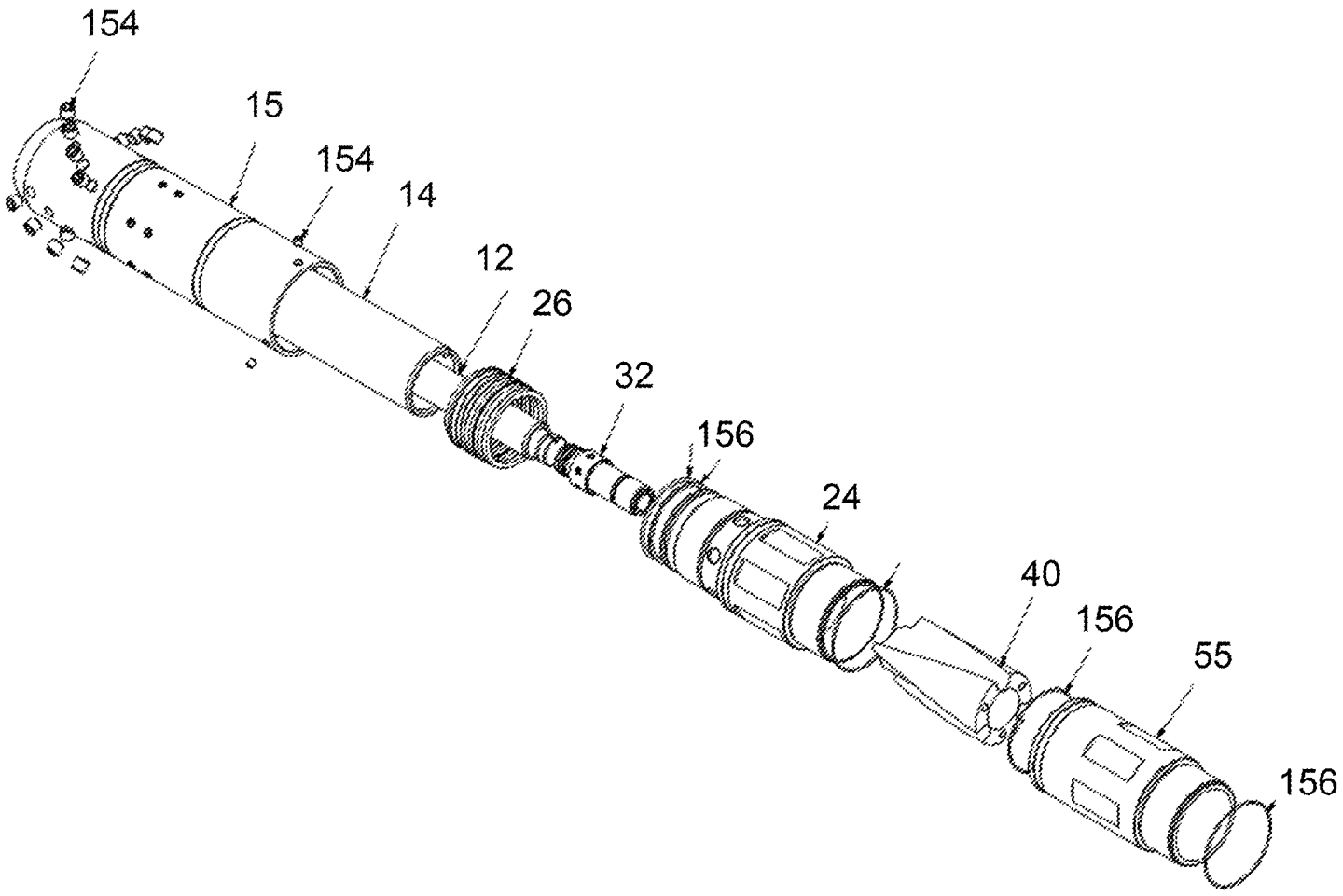
FIG. 4 is a further exploded isometric view of the coiled tubing spiral venturi tool shown in FIG. 1.
Figure 5:
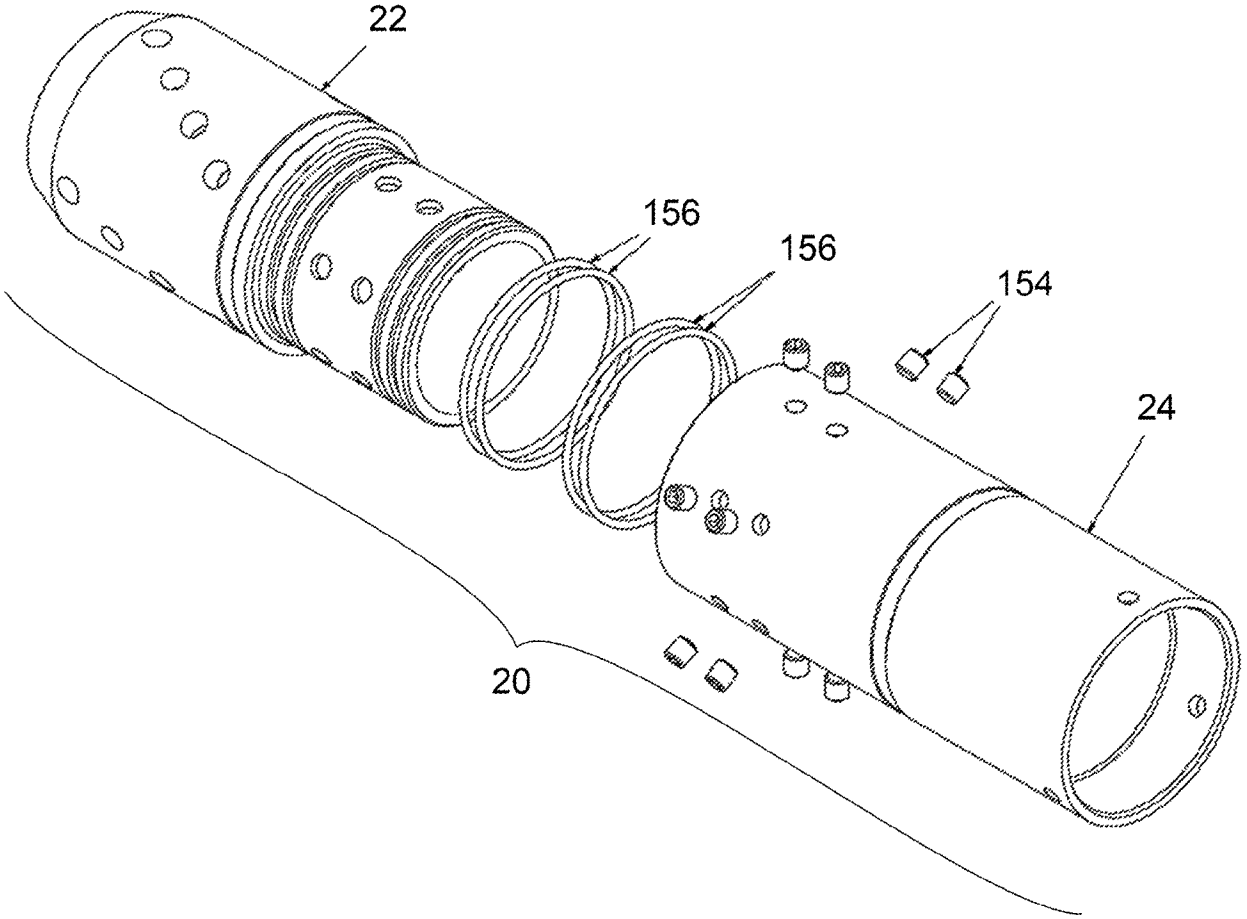
FIG. 5 is an exploded isometric view of an external connector component for sealingly mounting the coiled tubing spiral venturi tool to a concentric coiled tubing string.

Demountable engagement of the coiled tubing spiral venturi tool to a concentric coiled tubing is shown in FIGS. 4 and 5 wherein the concentric coiled tubing has an inner tubing 12 and an outer tubing 14 that is engaged by an outer tubing disconnect assembly 20. The external connector top sub 22 of the outer tubing disconnect assembly 20 is slid over the outer tubing 14 of the concentric coiled tubing. A seal pack assembly 26 is slid over the outer tubing 14 and into the annular space between external connector top sub 22 and the outer tubing 14. An inner disconnect roll-on assembly 32 is inserted into the concentric coiled inner tubing 12 and mechanically fastened in place. A venturi plate transition component 40 is slid over the inner disconnect roll-on assembly 32 into the annular cavity between the inner disconnect roll-on assembly 32 and the concentric coiled outer tubing 14, thus centralizing the inner components of the coiled tubing spiral venturi tool with the outer components of the coiled tubing spiral venturi tool. Then, the external connector bottom sub 24 is slid over the venturi plate transition component 40 and the outer tubing 14 and is coupled to an external connector component 15 that is in turn, coupled to the external connector top sub 22. The coupling together, using set screws 154 of the external connector top sub 22, the external connector component 15, and the external connector bottom sub 24 compresses a seal pack assembly 26 in the annular cavity between the concentric coiled outer tubing 14 and the outer tubing disconnect assembly 20 thereby sealing the coiled tubing spiral venturi tool to the concentric coiled tubing. Additional sealing of the connections between the components comprising the outer tubing disconnect assembly 20 is provided by use of O-rings 156. It is within the scope of the present disclosure to vary the numbers of set screws used to couple together the components comprising the outer tubing disconnect assembly 20 to provide leak proof engagement of the coiled tubing spiral venturi tool with different types and diameters of concentric coiled tubings and for different types of wellbore applications. It is also within the scope of the present disclosure to provide set screws to break under specified shear stress levels to allow the coupled coiled tubing spiral venturi tool and concentric coiled tubing to separate under axial tension.

Figure 6:
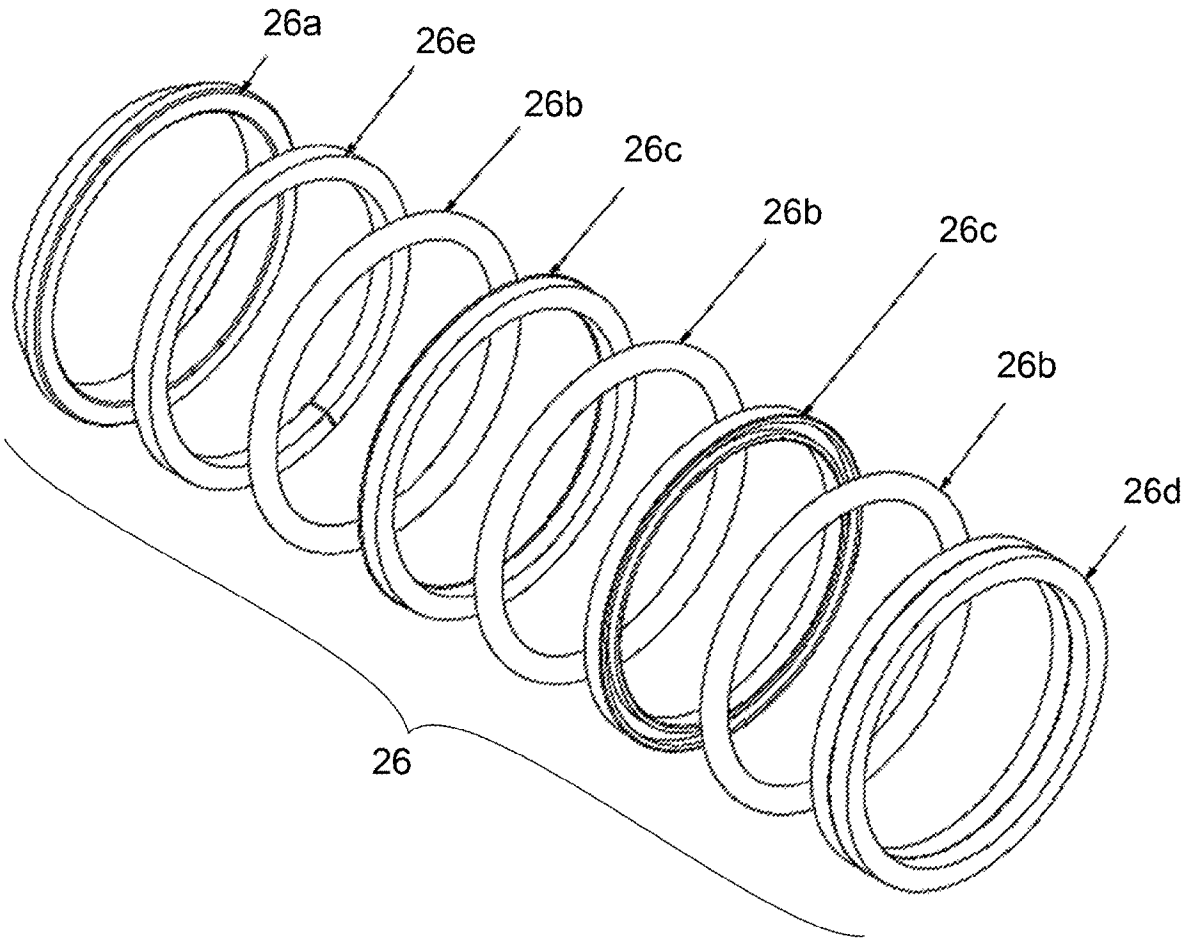
FIG. 6 is an exploded isometric view of a seal assembly component of the coiled tubing spiral venturi tool.

An embodiment of a suitable seal pack 26 for use with the coiled tubing spiral venturi tool disclosed herein is shown in FIG. 6. A metal ring 26*a* is assembled in parallel with a series of sealing devices consisting of O-rings 26*b*, polypack cup seals 26*c*, and carbon fiber packings 26*d*, 26*e* (the thickness of 26*d* is twice the thickness of 26*e*) to form a compressible seal pack capable of withstanding high fluid pressures.

Figure 7:
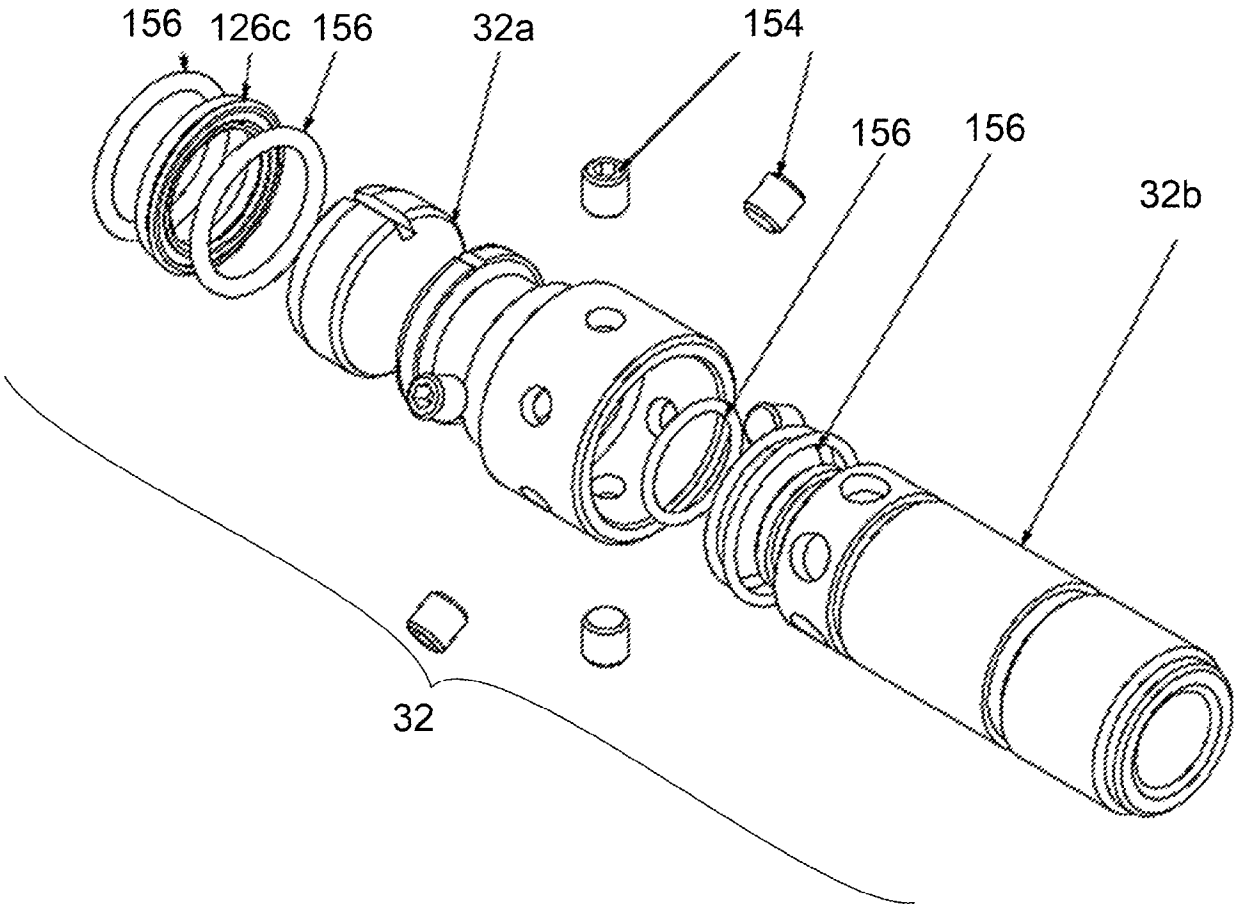
FIG. 7 is an exploded isometric view of an internal connector component of the coiled tubing spiral venturi tool.

An embodiment of an inner tubing roll on connector assembly 32 for use with the coiled tubing spiral venturi tool disclosed herein is illustrated in FIG. 7 wherein inner coil tubing upper connecter 32*a* and inner coil tubing lower connecter 32*b* are cylindrical bodies that are fastened together with multiple set screws 154. The number of set screws 154 installed is dependent on the application of the coiled tubing spiral venturi tool in a wellbore. If so required, the set screws 154 are allowed to break under shear stress to allow the coupled coiled tubing spiral venturi tool and concentric coiled tubing to separate under axial tension. Sealing devices, i.e. O-rings 156 are installed over the "roll on" end of the upper connecter 32*a*.

Figure 8:
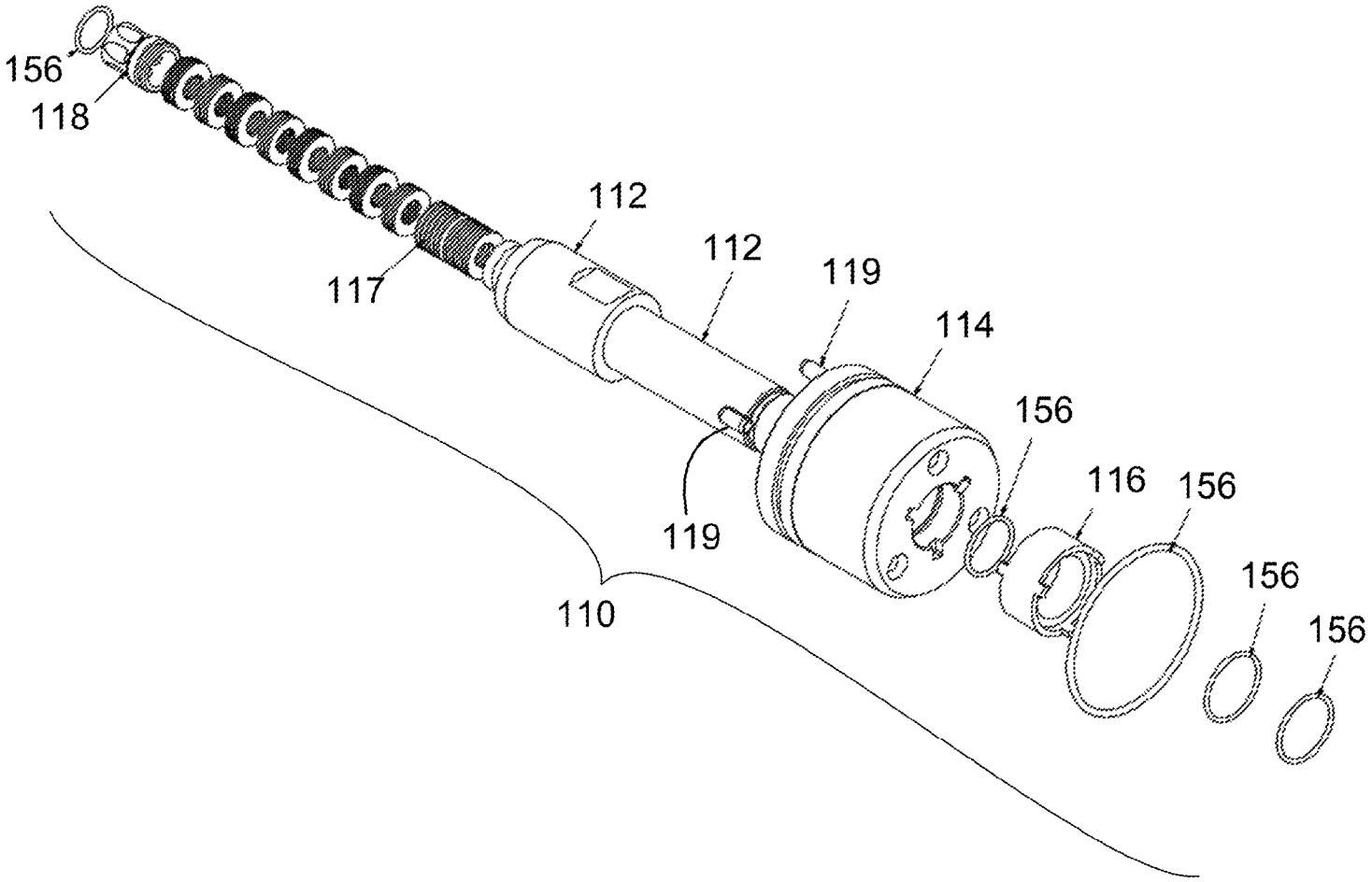
FIG. 8 is an exploded isometric view of a venturi plate component of the coiled tubing spiral venturi tool.
Figure 11:
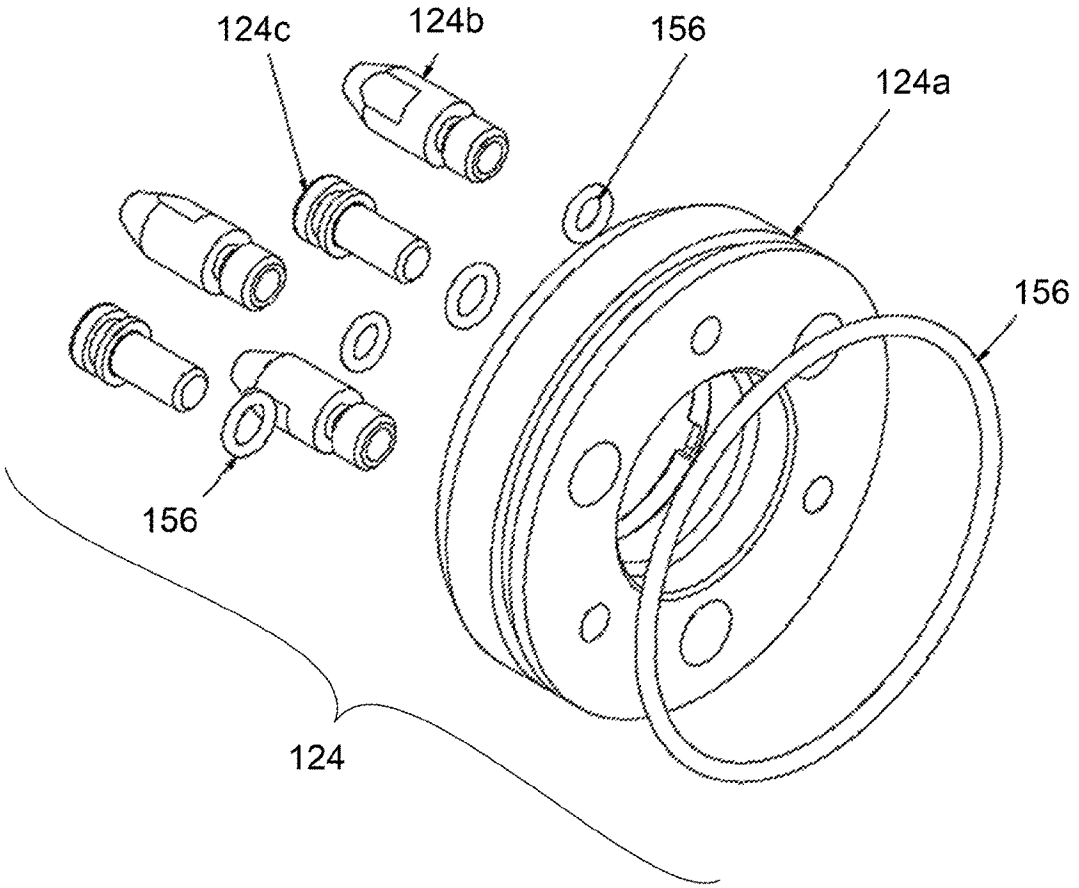
FIG. 11 is an exploded isometric view of a venturi nozzle plate assembly component of the coiled tubing spiral venturi tool.

An embodiment of a Venturi Plate Assembly 110 with the fluid column holding valve components for being used with the coiled tubing spiral venturi tool disclosed herein is illustrated in FIG. 8. The fluid column holding valve comprises a cylindrical flow tube 112 cooperating with a series of disc springs 117 assembled in series to support the holding valve plunge 118, which is exposed to the drive fluid. The fluid column holding valve will be normally closed containing the column of drive fluid contained in the inner tubing string until the drive fluid pressure is increased up to a level capable of compress the springs 117 allowing the drive fluid to pass through. The venturi plate 114 is a cylindrical body with an array of venturi cavities placed circumferentially around the centerline. The venturi alignment ring 116 is a tabbed cylindrical ring that is used to align the venturi plate 114 with the venturi jet nozzle plate assembly 124 (FIG. 11). O-rings 156 are used to seal pressure between threaded connections. Slotted spring pins 119 are fastening devices installed to align the venturi plate 114 with the venturi plate transition component 40.

Figure 9:
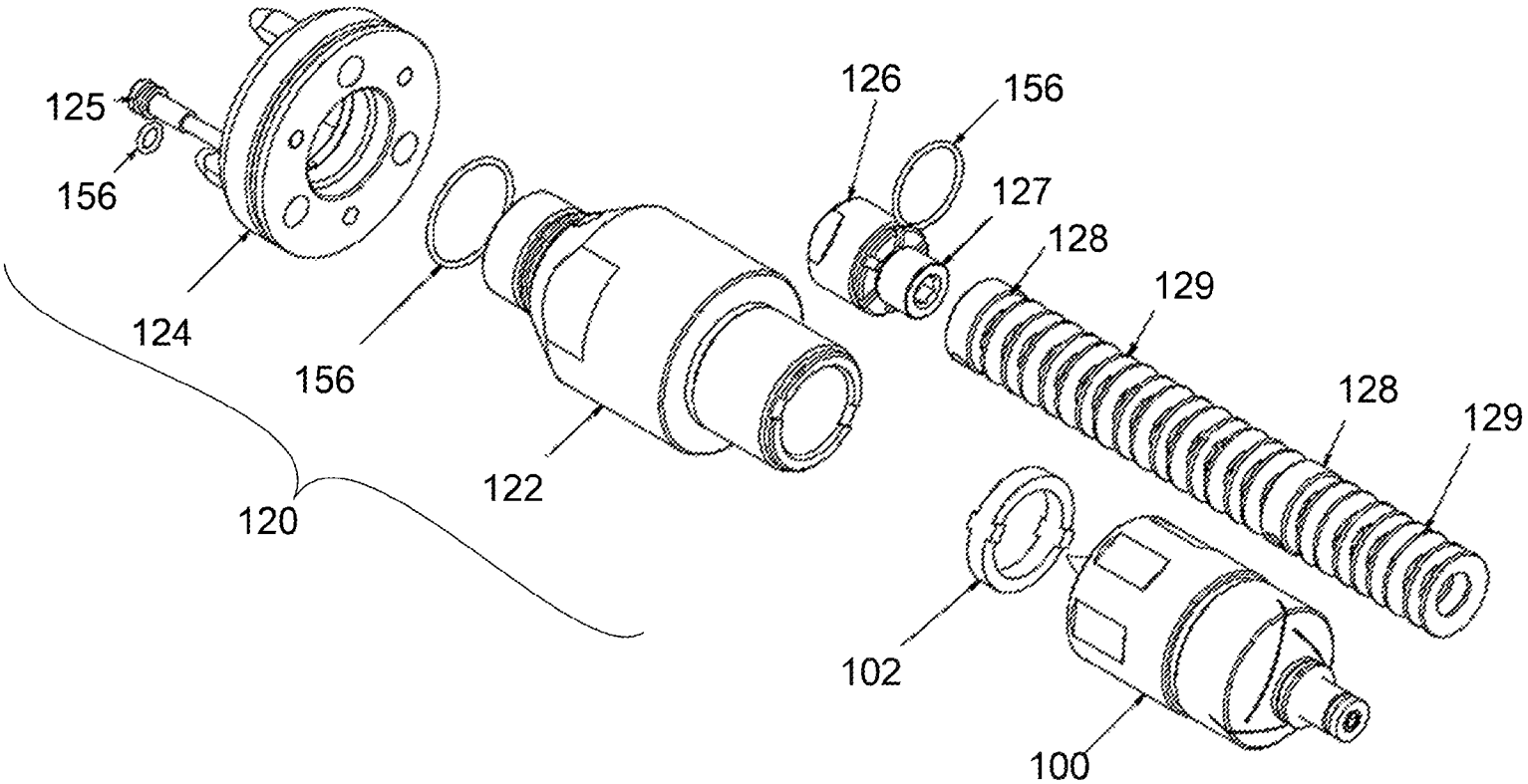
FIG. 9 is an exploded isometric view of a control valve assembly component of the coiled tubing spiral venturi tool.

An embodiment of a control valve assembly 120 cooperating with a Vortex Generating Wash Nozzle assembly 100 for being used with the coiled tubing spiral venturi tool disclosed herein is illustrated in FIG. 9. The control valve assembly 120 comprises a relief valve assembly 122 that contains a series of disc springs 129 assembled in series to support the control valve plunger called the "jet nozzle shift dart" 126. The jet nozzle shift dart 126 remains closed during fluid flow passing through a ported set screw 127 that is installed into the jet nozzle shift dart 126. Fluid flow will pass through the device and exit the Vortex Generating Wash Nozzle assembly 100. The primary shift stop sleeves 128 are fluid passage rings that allow fluid to pass through the disc springs 129 without restriction. A jet nozzle plate alignment screw 125 is provided to align the jet nozzle plate assembly 124 and the relief valve assembly 122. A swirl plate lock ring 102 is provided to prevent rotation of inner parts caused by fluid under pressure flowing through the Vortex Generating Wash Nozzle assembly 100. O-rings 156 are provided to seal the connections.

Figure 10:
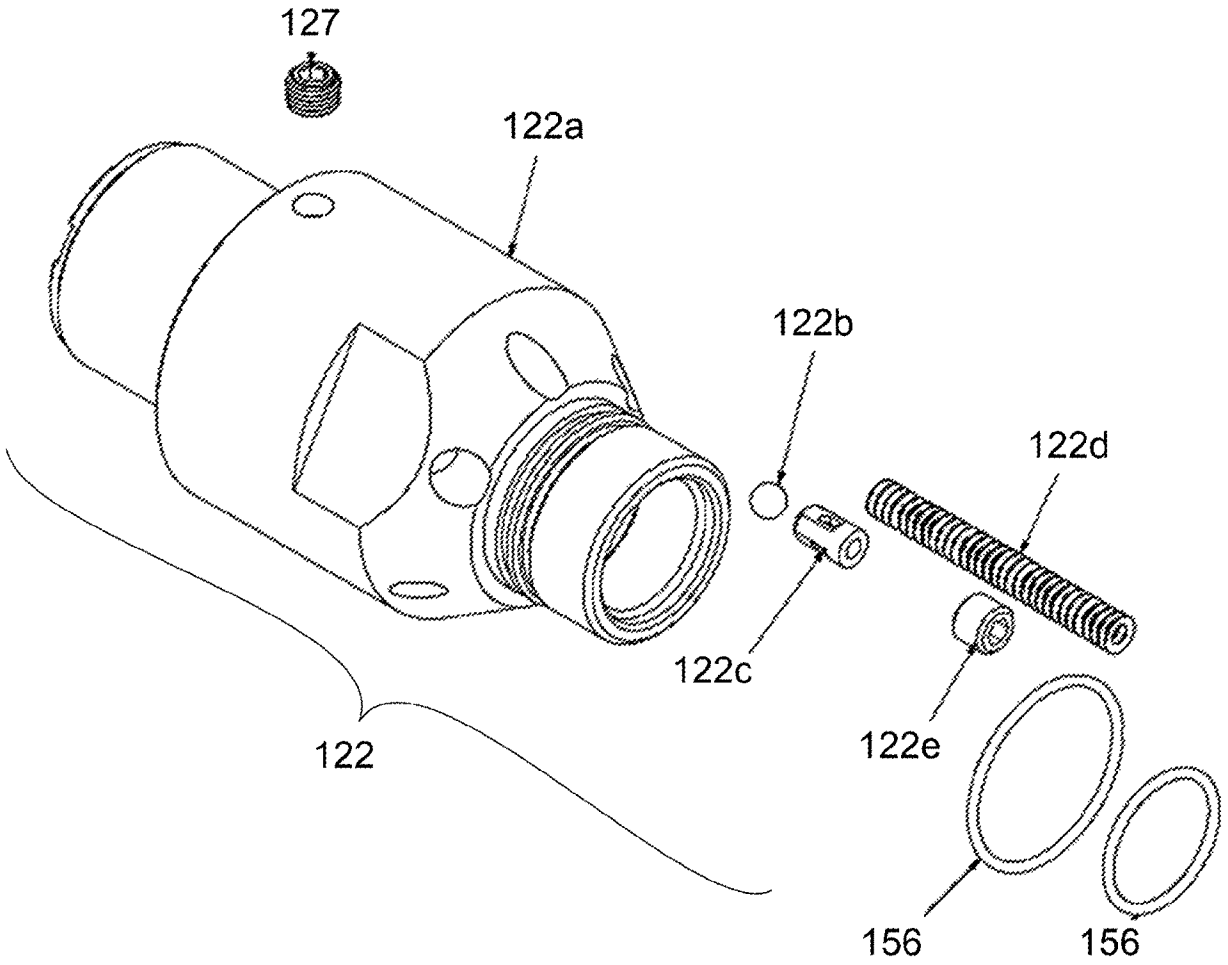
FIG. 10 is an exploded isometric view of a relief valve assembly component of the coiled tubing spiral venturi tool.

The relief valve assembly 122 from FIG. 9 is shown in more detail in FIG. 10 and generally comprises a venturi inlet sub 122*a* containing a series of disc springs 122*d* assembled in series to support a stainless steel ball 122*b* and a relief valve dart 122*c*. It is optional if so desired, to use coil springs instead of discs springs. Ported hex plug 127 is provided to adjust the spring tension and opening pressure of the relief valve assembly 122. The stainless steel ball 122*b* will open under a predetermined pressure allowing fluid under pressure to re-enter the control valve assembly 120 through drilled ports and open the jet nozzle shift dart 126.

The jet nozzle plate assembly 124 from FIG. 9 is shown in more detail in FIG. 11 and generally comprises a first embodiment of a venturi jet nozzle plate 124*a* with a plurality of venturi jetting nozzles 124*b* installed into the venturi jet nozzle plate 124*a* circumferentially around its centerline. A plurality of screw plugs 124*c* are also installed into the venturi jet nozzle plate 124*a*. O-rings 156 are provided to seal pressure between threaded connections.

Figure 12:
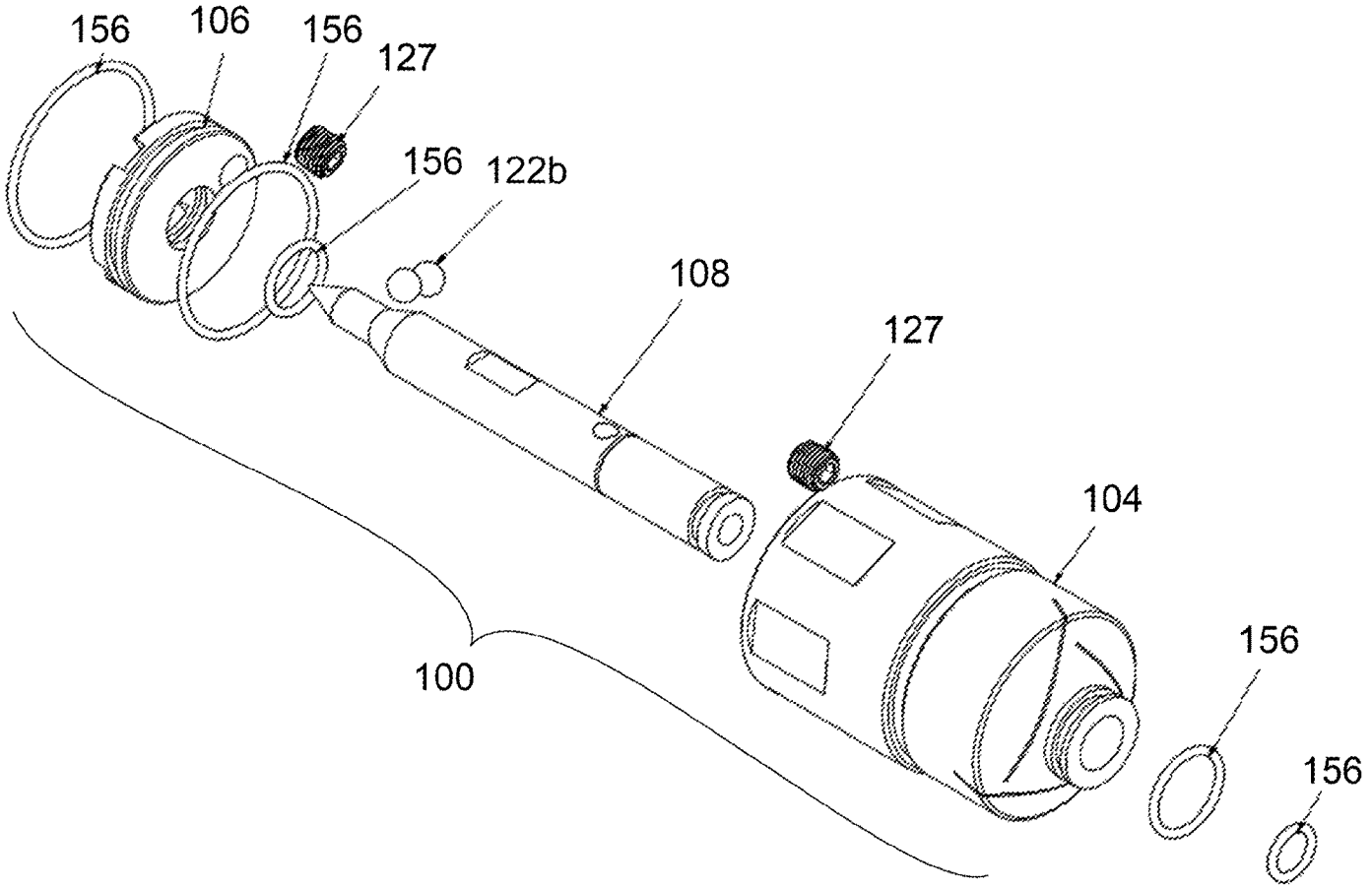
FIG. 12 is an exploded isometric view of a Vortex Generating Wash Nozzle assembly (PCT/CA2016/050751) component of the coiled tubing spiral venturi tool.

An embodiment of a spiral Vortex Generating Wash Nozzle 100 for use with the coiled tubing spiral venturi tool disclosed herein is illustrated in FIG. 12 and general comprises: (i) a Vortex Generating Wash Nozzle 104 that is a slotted cylindrical body to provide a high-pressure fluid jet stream to the front of the coiled tubing spiral venturi tool into a wellbore, (ii) a jet shutoff valve stem 108 that is a threaded hollow cylindrical shaft fitted with an ported set screw for use to adjust fluid flow through the Vortex Generating Wash Nozzle 104, and (iii) a nozzle swirl plate 106 fitted with a ported hex screw 127. The nozzle swirl plate 106 provides a non-parallel fluid flow to enter the Vortex Generating Wash Nozzle 104 thereby causing stainless steel ball 122*b* to rotate within the annular cavity defined by the Vortex Generating Wash Nozzle 104 and the jet shutoff valve stem 108. The jet shutoff valve stem 108 may adjusted to divert fluid to the Vortex Generating Wash assembly and jet nozzle venturis. O-rings 159 are provided to seal the connections.

Figure 13:
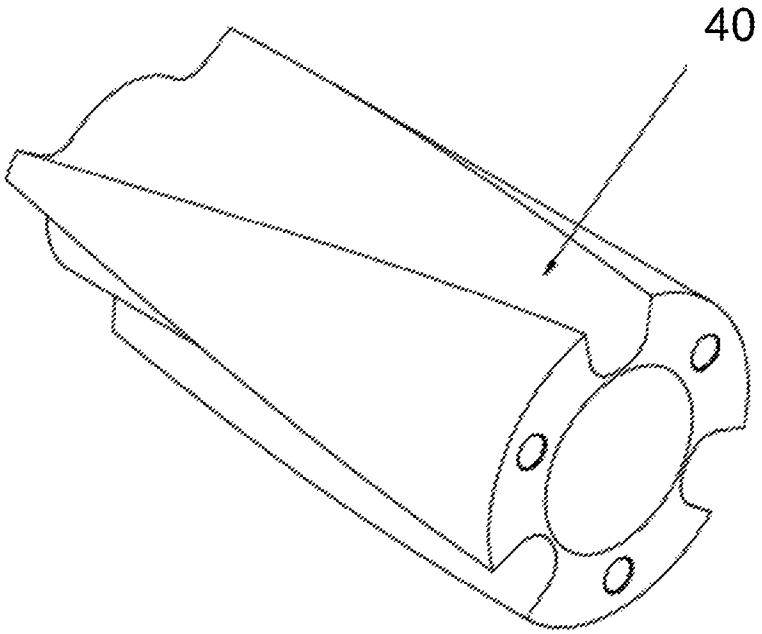
FIG. 13 is an isometric view of a venturi outlet transition component of the coiled tubing spiral venturi tool.

The venturi plate transition component 40 from FIG. 3 is shown in more detail in FIG. 13. As fluid exits the venturi plate assembly, the individual fluid paths are further expanded and transitioned to the full circular fluid flow of the annular cavity of the concentric tubing strings.

Figure 14A:
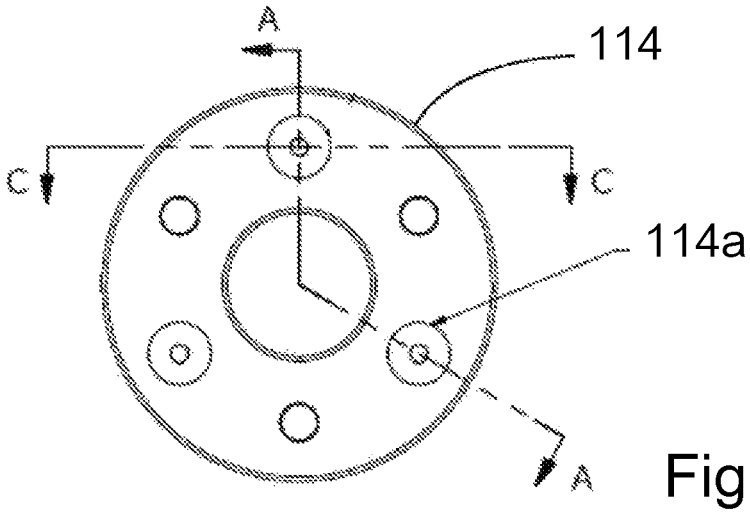
FIG. 14A is a bottom view of the venturi plate from FIG. 11 showing the placement of venturis circumferentially about the centre of the venturi plate component.
Figure 14B:
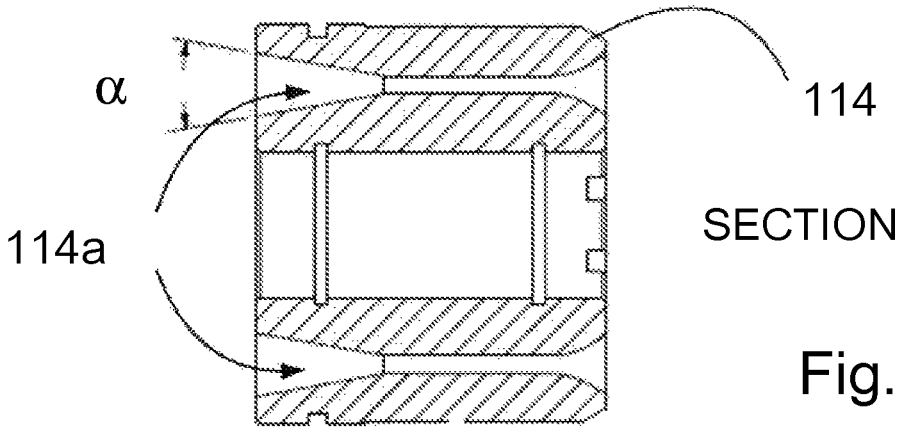
FIG. 14B is a longitudinal cross-sectional A-A view from FIG. 14A showing a standard conical diffuser shape of a venturi in a first plane.
Figure 14C:
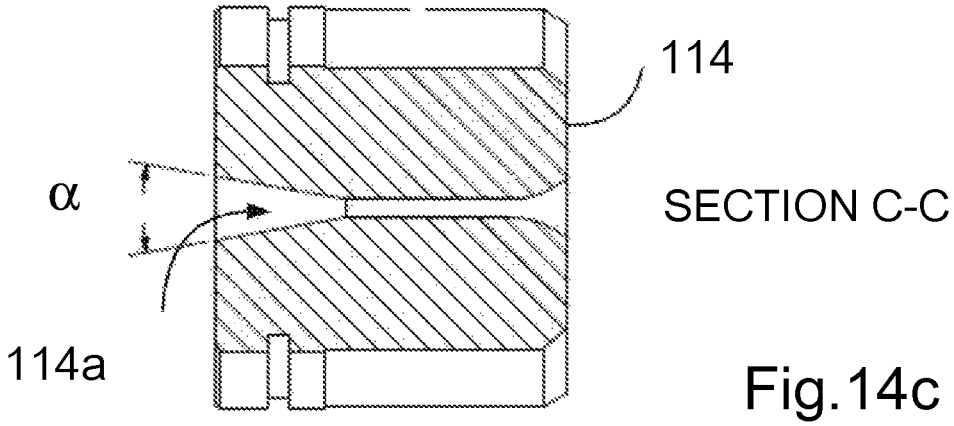
FIG. 14C is a longitudinal cross-sectional C-C view from FIG. 14A showing the conical diffuser shape of the venturi shown in FIG. 17B in a different plane.

FIG. 14A shows an end view of the venturi plate 114 of the preferred embodiment of the tool from FIG. 8, with three conical venturis 114*a* equidistantly distributed around its diameter. FIG. 14B shows a cross section through the venturi plate 114 from FIG. 14A at A-A showing a conical shape, while FIG. 14C shows a cross section through the venturi plate 114 from FIG. 14A at C-C.

One of the objectives of this invention is to have a tool that can be easily adapted to the different conditions of the wells where it will operate, mainly because of different types of fluids present in the well, depth and directionality of the well, type of work to be performed and type and composition of obstructions to be removed. In addition to the preceding figures which describe the typical components of the preferred embodiment of the invention and its basic functionalities, FIGS. 15-21 describe the modules which can be replaced, added or removed before introducing the tool into the well to obtain the best performance and higher operational reliability while maintaining the main functionalities from FIG. 1, resulting each possible combination of the basic tool or preferred embodiment with one or many of these modules in a different embodiment of the invention.

Figure 15A:
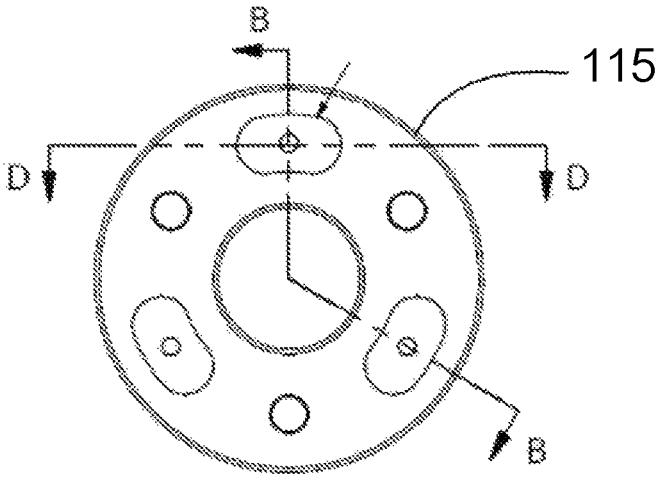
FIG. 15A is a bottom view of another embodiment of a venturi plate component showing the placement of venturis circumferentially about the centre of the venturi plate component.
Figure 15B:
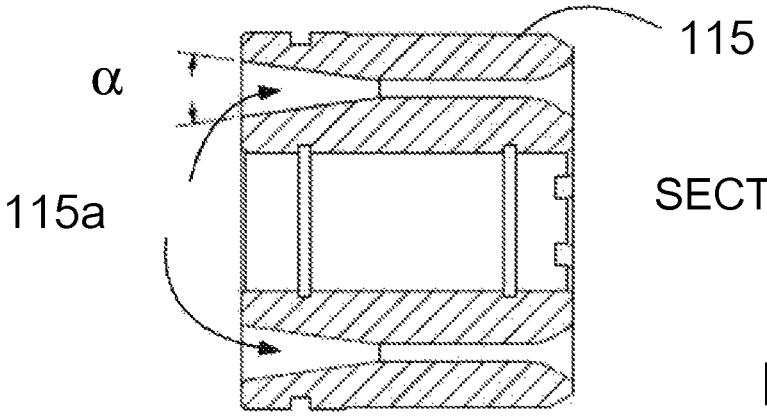
FIG. 15B is a longitudinal cross-sectional A-A view from FIG. 15A illustrating the non-standard conical diffuser shape of a venturi in first plane.
Figure 15C:
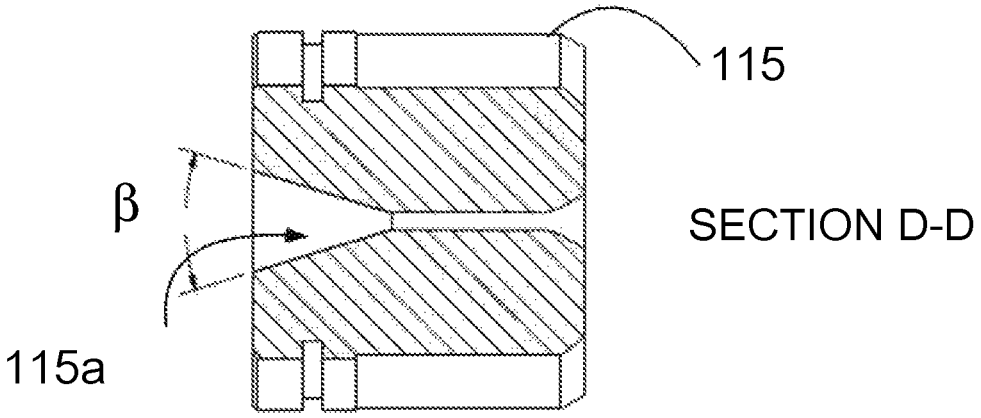
FIG. 15C is a longitudinal cross-sectional D-D view from FIG. 15A showing the non-standard conical diffuser shape of the venturi.

FIG. 15A shows a different module of the venturi plate 115, to replace plate 114 from FIG. 14*a*, having non-symmetrical venturi orifices 115*a* spaced equidistantly around the diameter of the venturi plate 115. FIG. 15B shows a cross section through the venturi plate 115 from FIG. 15*b* at B-B showing an asymmetrical ovaled shape, while FIG. 15C shows a cross section through the venturi plate 115 from FIG. 15A at D-D. The purpose of the change in the conical shape between orifices 115*a* and 114*a* obeys to make a better flow transition and unification from the multiple venturi diffuser into the common discharge. It is within the scope of this disclosure to provide 2, 3, 4, 5, 6, 7, 8, 9, 10 conical or non-symmetrical oval shaped venturis, which can be equidistantly distributed around the diameter of a venturi plate or follow a different pitch between them not necessarily constant, in order to better adapt to the type of well fluids and solids to be suctioned. It is also considered in order to produce different effect on the suction properties, the use of different size or diameter venturis within the same plate.

Figure 16A:
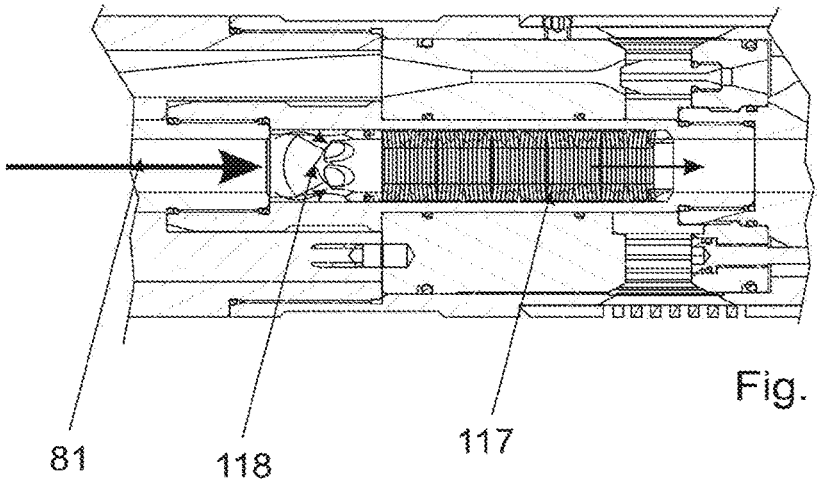
FIG. 16*a* is a partial longitudinal section view of the zone of the Hold Down Valve of the preferred embodiment of the tool.
Figure 16B:
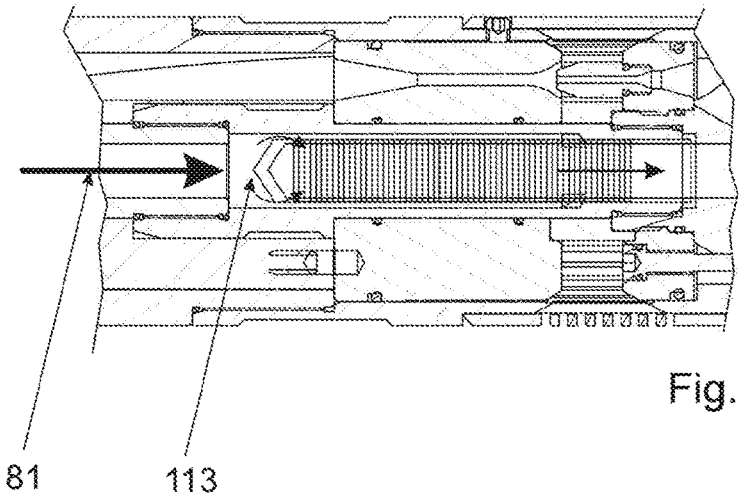
FIG. 16*b* is a partial longitudinal section view of the zone of the Hold Down Valve seating with the Hold Down Valve assembly removed showing an alternative embodiment of the tool including the Inline Filter.

FIG. 16*a* shows a partial longitudinal section view of the preferred embodiment of the tool on the area of the column hold valve 118 with the springs 117. FIG. 16*b* shows an alternative embodiment of the tool (without showing the hold down valve 118 and springs 117 for clarification purposes) where an inline filter 113 is placed downstream to the regular column hold valve plunger position, which can be installed to avoid the entrance of solids being carried by the power fluid 81 into the small fluid conduits of the tool, especially the jetting nozzles and venturi nozzles, which could clog them and make them inoperative, reducing the performance of the tool even making the operation to fail. The inline filter 113 is intended to catch the solids produced by any working fluid clot or debris coming from the internal surface of the coil tubing, which cannot be filtered by the in-surface filtering unit. To prevent impurities captured by the filter from obstructing the passage of the fluid downstream when the tool is in the well, there is provided a self-cleaning method consisting of making consecutive opening and closing cycles of the fluid column valve or which causes a partial deformation and movement of the filter making the solids on it to rearrange and move to one side. The inline filter 113 can also improve reuse of the Power Fluid 81. The filter is not provided as a default component on the preferred embodiment of the tool because it produces a drop in the pressure downstream which could reduce both the suctioning and the jetting power of the tool, and it is only included when suspected to be present the clogging risk. Alternative embodiments of the tool could comprise the complete removal of the hold down valve 118 and springs system 117 leaving only the inline filter 113, with the disadvantage of eliminating the "Reset" operation mode of the tool and leaving no procedure for cleaning the filter.

Figure 16C:
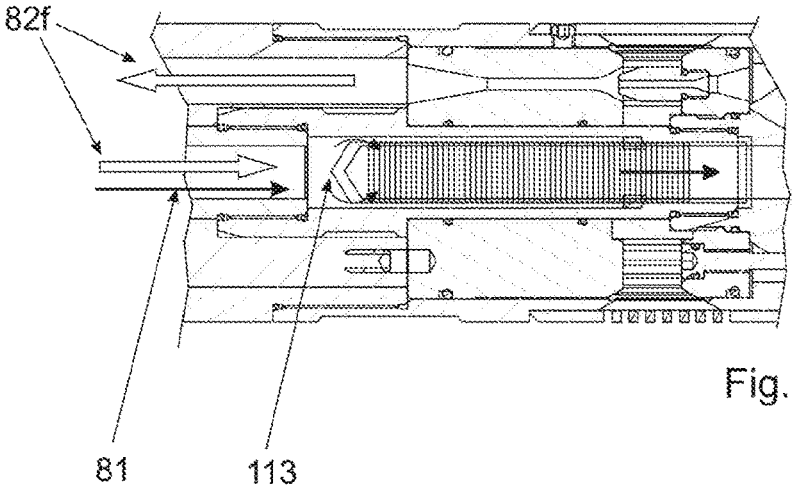
FIG. 16*c* is a partial longitudinal section view of the zone of the Hold Down Valve seating with the Hold Down Valve assembly removed showing an alternative embodiment of the tool including the Inline Filter when recirculating the return fluids.
Figure 17:
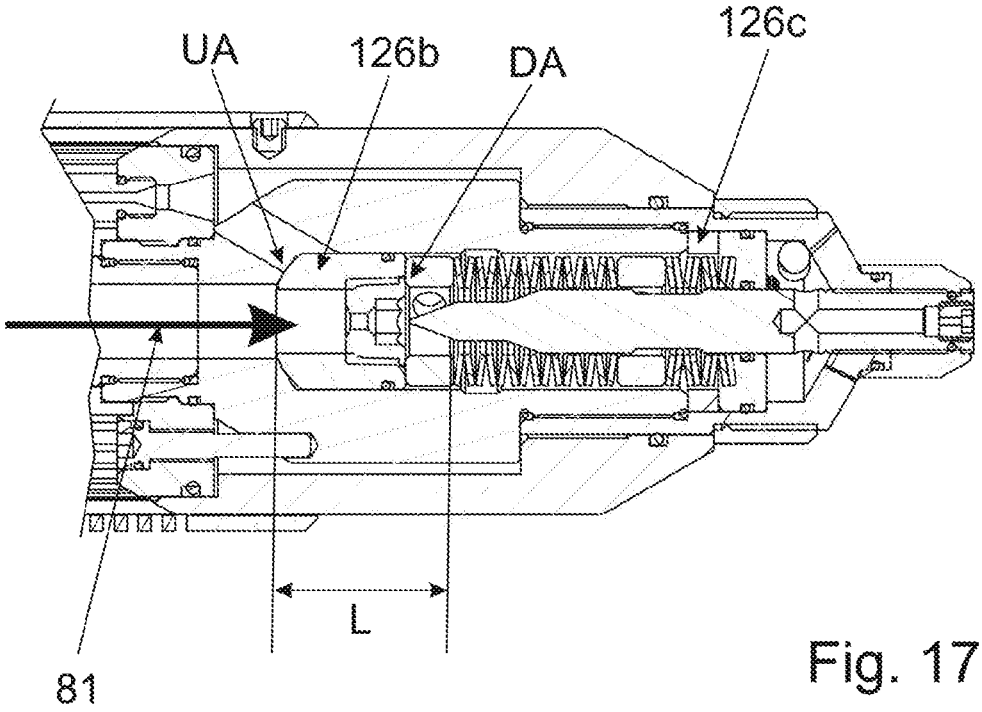
FIG. 17 is a partial longitudinal section view of an alternative embodiment of the tool showing the zone of the Vortex Generating Washing Nozzle and the Control Valve Assembly, with an alternative Control Valve Piston placed on its closed position.

FIG. 16*c* represents one of the main advantages of the use of the inline filter 113, which are filtering low treatment fluids at the entry of the tool in operations involving the recirculation of the return fluid 82*f* to be pumped down to the bottom hole assembly together with the non-used power fluid 81.

In order to increase the effectiveness of the jetting effect when removing hard solids like scales or when the wellbore fluids are at high pressure, it is required the tool to deliver a higher pressure jet, which requires operate a higher power fluid pressures on the "Jet Only" operation mode of the tool. For doing this, the control valve shift dart 126 FIG. 9 of the preferred embodiment of the tool can be replaced by a different shape shift dart 126*b* shown in FIG. 17, which length L is longer, have a bigger upstream area UA facing the power fluid in order to improve the sealing with the venture conduits, and a smaller downstream area DA facing the high pressure fluid on the nozzle area, to reduce the effect on the shift dart 126*b*. In order to reduce the DA area, it can be required to insert an adapter sleeve element 126*c*.

Figure 18B:
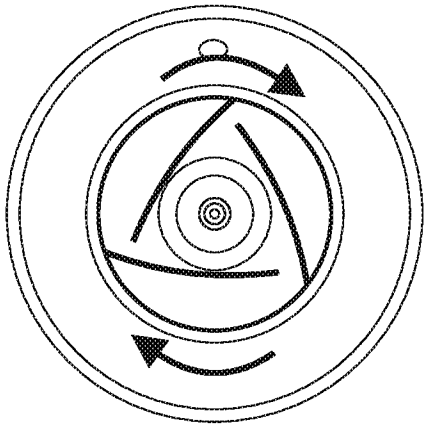
FIG. 18*b* is a front view of the alternative embodiment of the tool as shown in FIG. 18*a*, with arrows indicating the rotational movement of the Rotative Vortex Generating Washing Nozzle assembly.
Figure 18A:
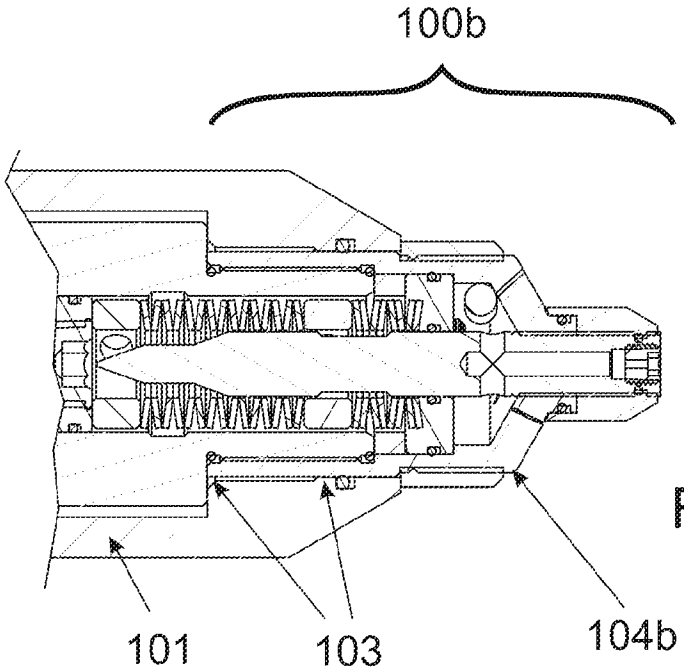
FIG. 18*a* is a partial longitudinal view of an alternative embodiment of the tool showing a Rotative Vortex Generating Washing Nozzle assembly.
Figure 19:
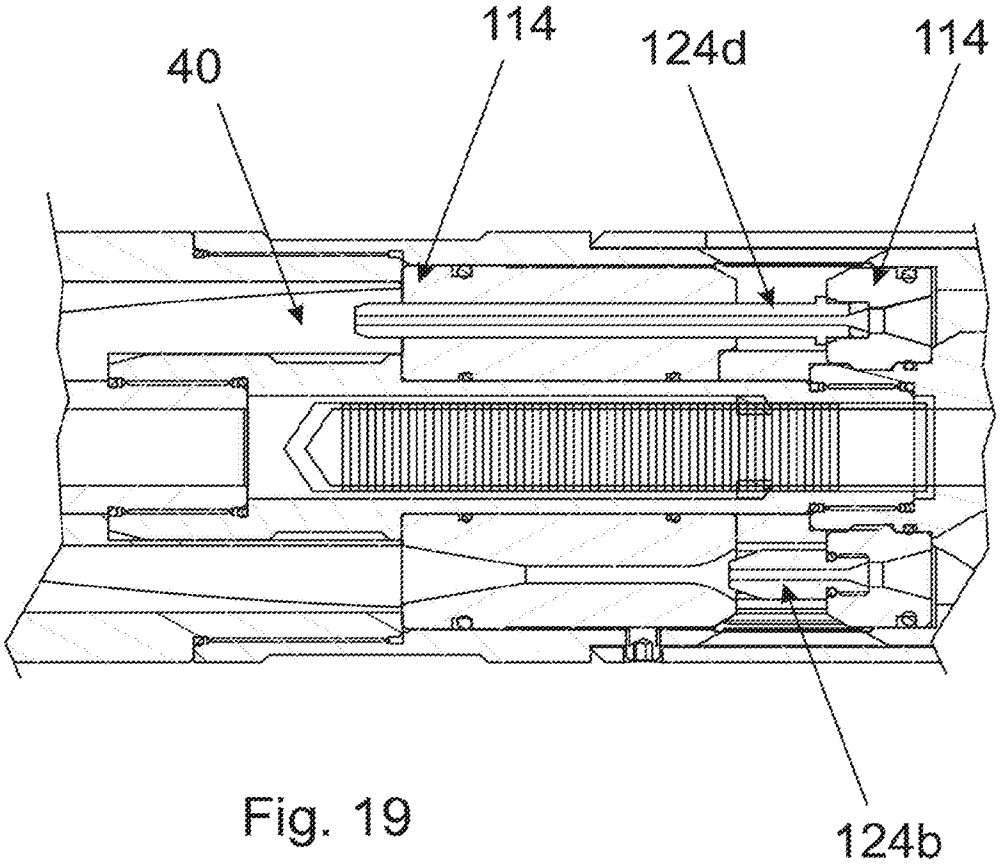
FIG. 19 is a partial longitudinal view of an alternative embodiment of the tool showing at least one Power Fluid Tube installed in the place of one of the Venturi Nozzles.

In order to enhance the tool capability in solid removal when certain well conditions like high viscosity wellbore fluids or high pressure is present, the Vortex Generating Wash assembly described for the preferred embodiment of the tool which is a static jetting module can be replaced by a Rotating Vortex Generating Wash assembly 100*b* as shown in FIG. 18*a*, consisting on a Rotating Vortex Generating Wash Nozzle 104*b* capable of rotating concentric to the housing 101*b* by means of an axially restricted low friction slack fit between the cylindrical faces of both elements, with the fluid sealing adding sealing rings 103 to make it possible to rotate as shown by the arrows in FIG. 18*b* with in order to aid to the spiral currents creation. This rotational assembly could represent a higher reliability risk for the tool while operating in the wellbore because of the failure of the sealing ring components and the progressive wearing of the mating faces, reasons why this is an alternative embodiment of the tool instead of the preferred one with the static Vortex Generating Washer Nozzle Assembly An alternative embodiment of the present invention for operations involving heavy or highly viscous wellbore fluids is shown in FIG. 19 which is partial longitudinal section view on the area of the venturi assembly, where a long tubular element called Power Fluid Tube 124*d*, is assembled in replace of at least one of the venturi jetting nozzles 124*b* located over the venturi jet nozzle plate 124*a*, passing through the venturi plate 114, with the function of supplying high pressure Power Fluid directly to the area of the venturi diffuser transition 40, with the purpose of providing higher pressure to pump up to the surface those viscous or heavy wellbore fluids located in that zone of the tool. When the power fluid tube 124*d* is installed, the tool loses some of its suctioning capability due to the cancelling of at least one of its venturis being replaced, reason why this is an alternative embodiment of the tool instead of the preferred one.

Figure 20A:
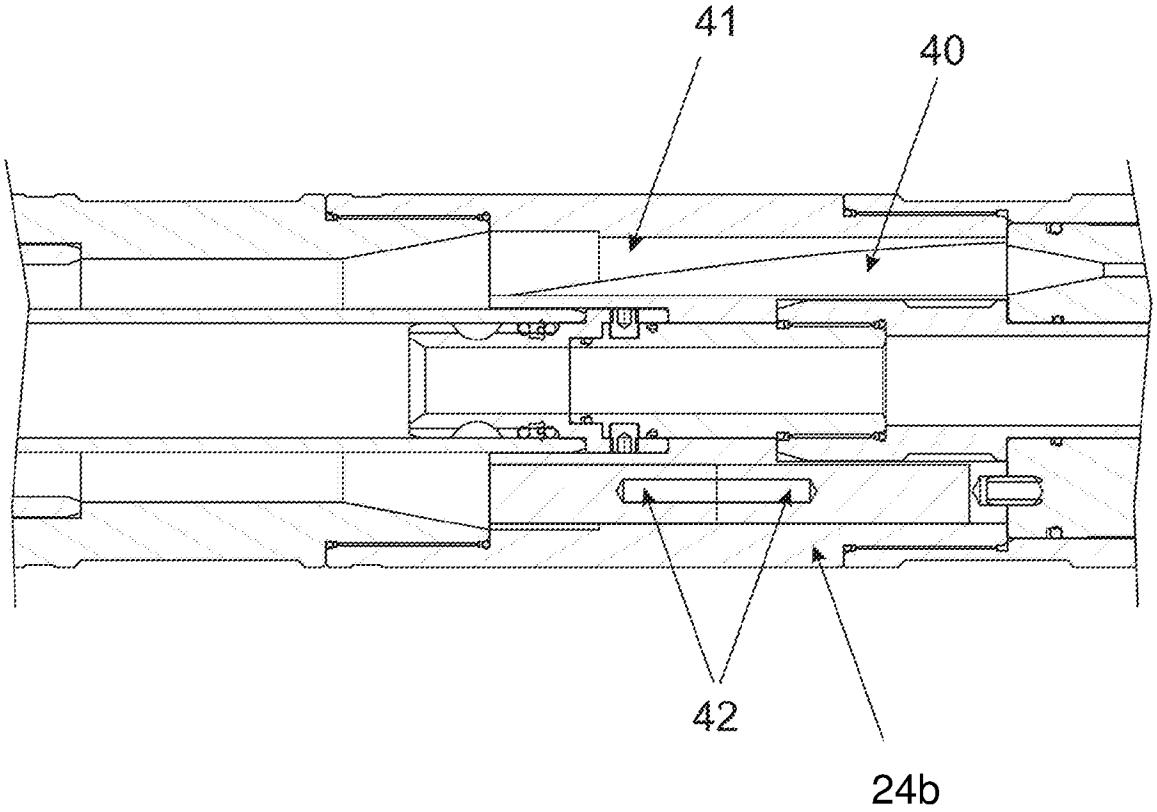
FIG. 20*a* is a partial longitudinal view of an alternative embodiment of the tool showing the assembly of a primary and a secondary Venturi Transition Plate.
Figure 20B:
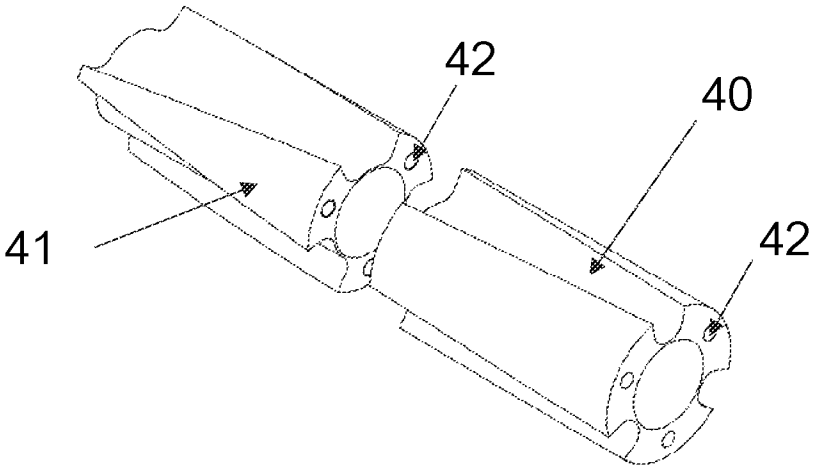
FIG. 20*b* is an exploded isometric view of the primary and secondary Venturi Transition Plates.

Other way to increase the pumping pressure of the suctioned wellbore fluid is to make the venturi diffuser transition plate as long as possible to increase the velocity to pressure conversion. To achieve the longest possible length in the diffuser it can be rearranged the typical tool assembly of the preferred embodiment to include additional venturi transition modules as shown in FIG. 20*a* and FIG. 20*b*, where it is added one secondary venturi transition plate 41 to the venturi transition plate 40, being possible to add more than one secondary venture transition plates, all of them aligned between each other by means of the aligning features 42 and with respect to the mating components by means of locating features. When this tool rearrangement is made, it is also required to replace the external connector bottom sub 24 by a longer one 24*b*, which makes the total length of the tool longer. The reason to use a short venturi transition plate 40 in the preferred embodiment of the tool, instead of a long one or even the array of more than one as in FIG. 20*a*, is because it also increases the total length of the tool assembly, which is something to be avoided considering that the longer the tool, the higher the risk of this tool to get stuck in the wellbore or conduit because of its greater rigidity compared to that of the coil tubing.

Figure 21:
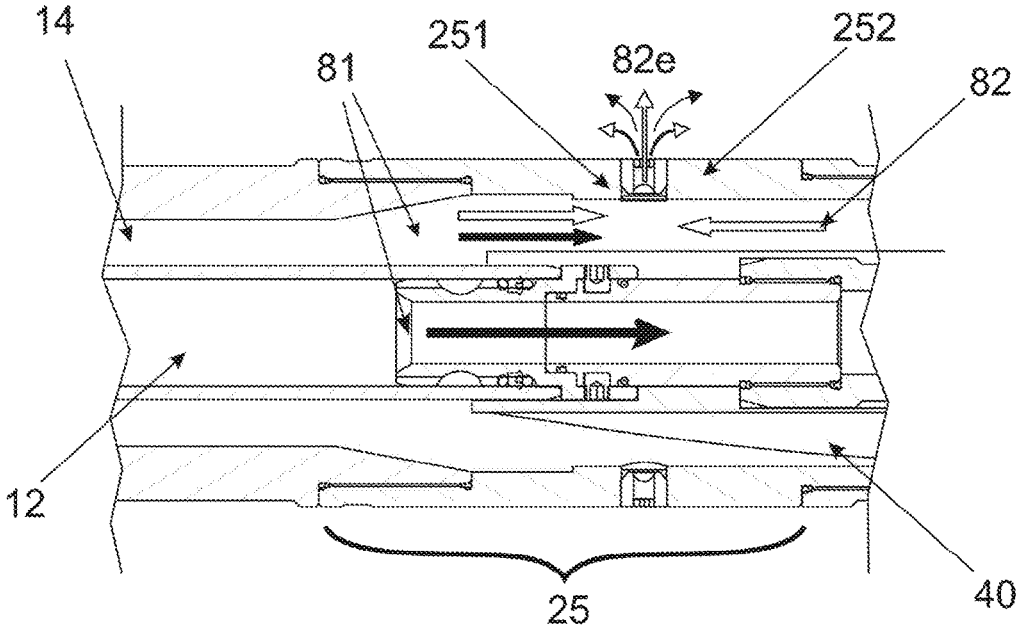
FIG. 21 is a partial longitudinal section view of an alternative embodiment of the tool with the Rupture Device installed with the internal fluid inside the tool flowing through the Rupture Nozzle.

To minimize the risk of the tool getting stuck in the conduit because of the built up solids around it during operation, it can be added a module called rupture device assembly 25 shown in FIG. 21 which replaces the external connector bottom sub 24 (FIGS. 4 and 5) of the preferred embodiment of the invention. The rupture device assembly 25 is composed by the rupture nozzles 251 which are conduits normally closed with an internal pressure sensitive mechanism to open when the internal pressure on the tool reaches the rupture pressure, which is higher than the maximum operating pumping pressure of the venturi jet pump in the area of the venturi transition plate 40 FIG. 1*a* and the annular conduct 14 of the coil tubing. To achieve the rupture device the tool must be operated in an special mode involving to pump down the Power Fluid 81 represented by black arrows through both the internal conduit 12 and the annular conduit 14 of the coil tubing, in order to create a pressure enough on the fluid located on the venturi transition plate, which will be a mixture of the Power Fluid 81 and the wellbore fluid 82 identified by the arrows 82*e*. Once the rupture pressure is reached, the jet produced by the rupture nozzles 251 can remove part of the obstructing solids external to the tool and also produce some lateral movement of the tool which can lead to the release of the tool accompanied by the pulling or pushing movement of the coil tubing. The typical embodiment of the rupture device assembly 25 comprises at least one rupture nozzle 251 aligned with each of the venturi conduits (three for the preferred embodiment of the tool), located on the rupture sleeve connector sub 252.

In a similar procedure that described in FIG. 21 to activate the rupture device, it can be cleaned or unplugged the suction screen 140 and the slotted suction head housing 130, by pumping down power fluid through both the internal conduit 12 and the annular space 14 of the coiled tubing, which increases the tool reliability and makes possible to perform continuous operation with the tool in the well without the need to remove it from the well.

The tool described in this document for any of the presented embodiments can operate in four different theoretical modes associated to the four possible combination between the Hold Down Valve and the Control Valve, according to the type of action to be performed, some of them being done with the tool moving upwards, or downwards or while stationary. FIGS. 22-25 show a longitudinal section view of an embodiment of the invention, located in an unspecified portion of a well, describing each of the basic modes of operation of the tool. The tool is immersed on the well fluids 82, contained by a conduit or case 84 and at that unspecified portion of the well there are some obstructions 82*c* like those due to sedimentation. The principle used to switch between modes of operation is the variation on the pressure level of the drive fluid (DF) (pumped from a coil tubing pressure surface unit), described by arrow 81 passing through the inner tubing 12 of the concentric coil tubing system to which the tool is attached, and enters the coil tubing spiral venturi tool assembly (CTSVT) 1 via the inner coil tubing lower connecter 32*b*. The passage of this drive fluid 81 through the tool is conditioned to its pressure level can open internal pressure-sensitive valves, which allow to communicate the different work elements of the tool, so that different nozzles and venturis can act in a selective way to perform the different actions of cleaning and collection of the debris and residues inside the well or conduit. In order for the tool to be able to operate, the surface unit is required to pump the drive fluid into four different pressure ranges, which will be called the BP (base pressure) range, LP range (low pressure), MP range (medium pressure) and HP range (high pressure); there being no limits or physical values established for them, and these ranges vary depending on the configuration and adjustments made to the tool before entering it into the well or conduit.

Figure 22:
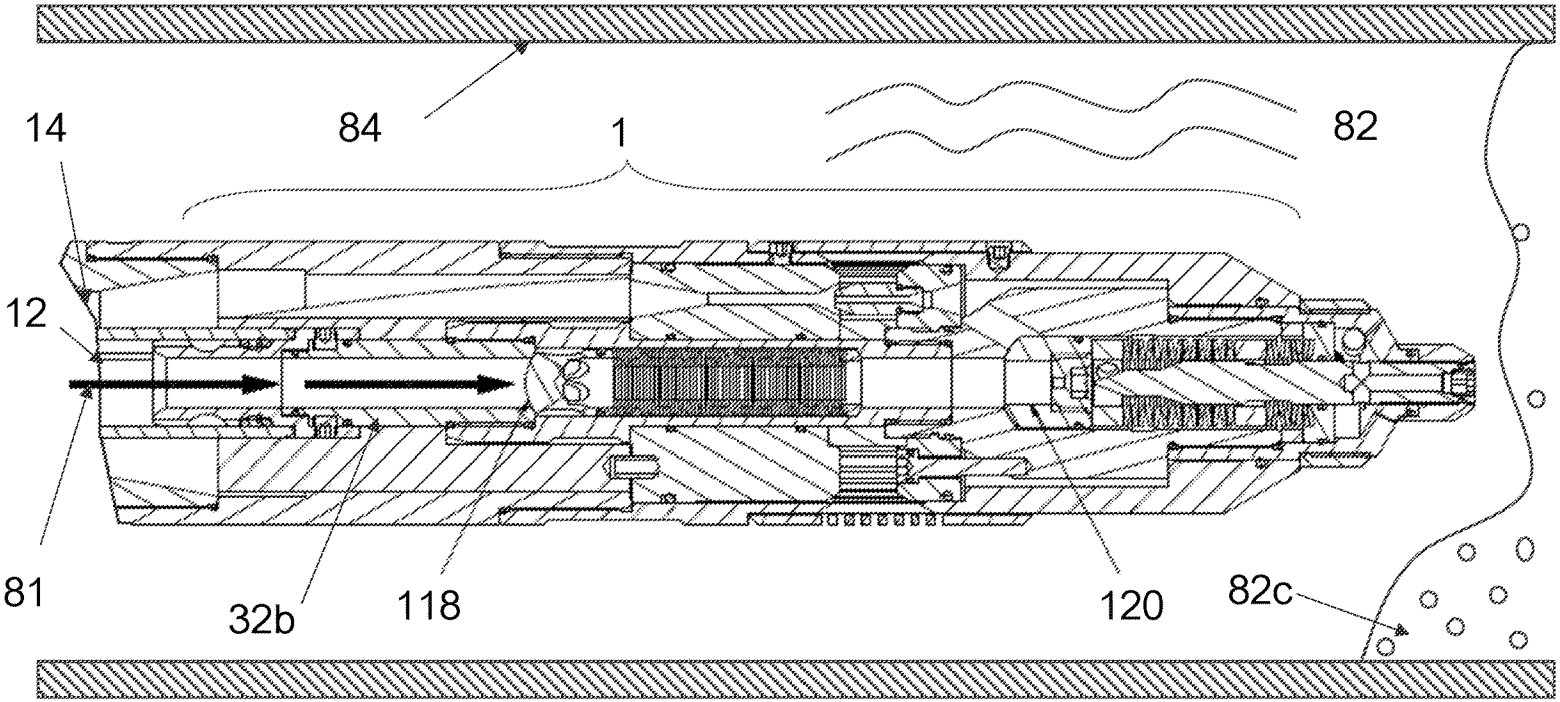
FIG. 22 is a longitudinal cross-section of the preferred embodiment of the coiled tubing spiral venturi tool located downhole in a wellbore illustrating the operation under the "Reset" mode.

FIG. 22 describes the so called "Reset" operation mode of the tool, in which the drive fluid 81 is in the pressure range BP which is lower than the pressure required to overcome the resistance of the fluid column hold valve 118, preventing the flow of the fluid to the control valve assembly 120 and the rest of the internal conduits, nozzles and venturis of the tool. No well fluid represented by wavy lines 82 or material on the outside of the tool is drawn by suction into the tool or pumped up to the surface through the annular space between the outer tubing 14 and the inner tubing 12, and no drive fluid 81 leaves the tool to the well. This operation mode can be used, but is not limited to the downwards or upwards traveling stages of the tool, to downhole hold-on stops or switch between other operation modes of the tool, or for different operations like on surface equipment calibration or testing, having two main advantages, first to avoid loss in drive fluid when it is not performing some tool work cycle, representing energy and fluid savings, and second having always a base pressure level on the drive fluid 81 allowing to move rapidly from one operation mode to another, representing time saving and increasing tool effectiveness.

Figure 23:
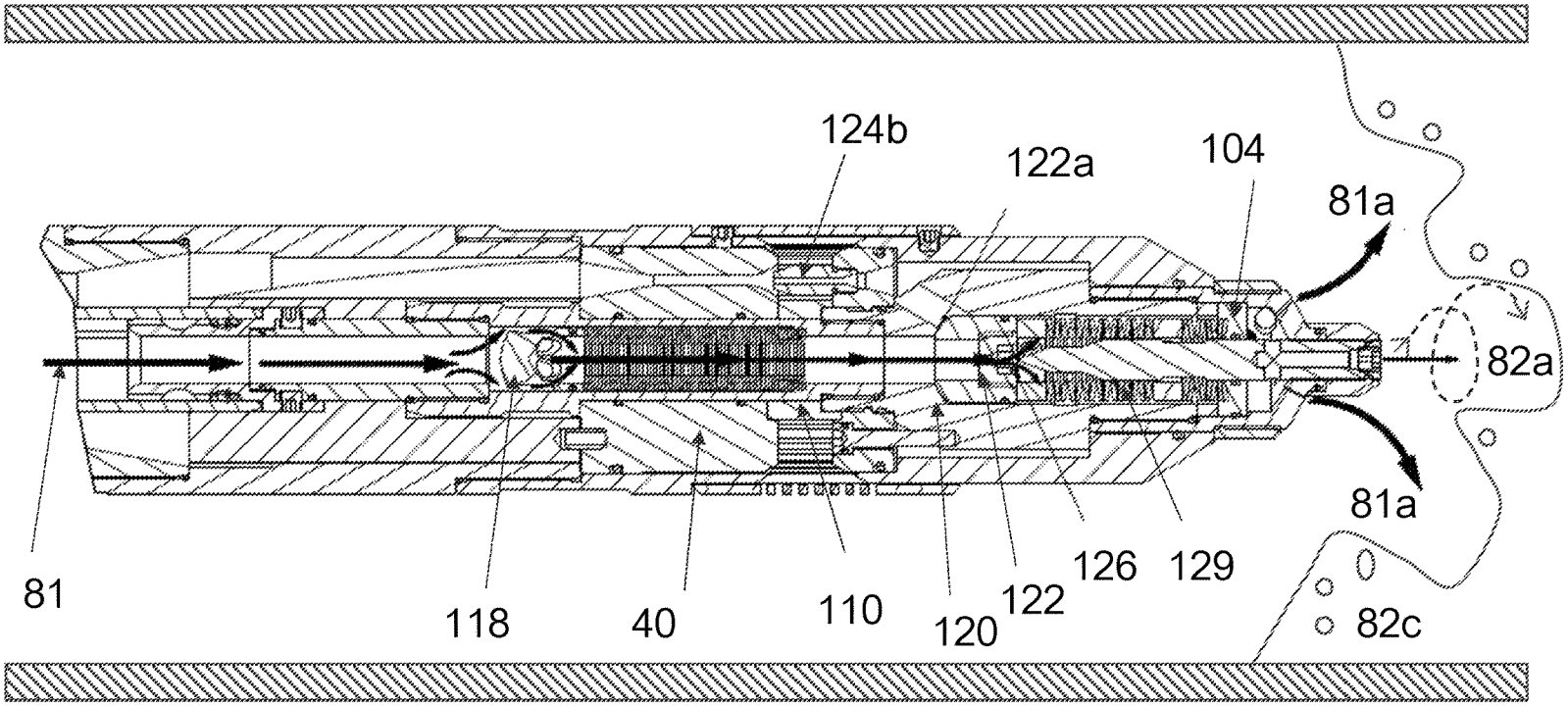
FIG. 23 is the longitudinal cross section of the preferred embodiment of the present invention shown in FIG. 22, illustrating the "Well Jet" operation mode.
Figure 24:
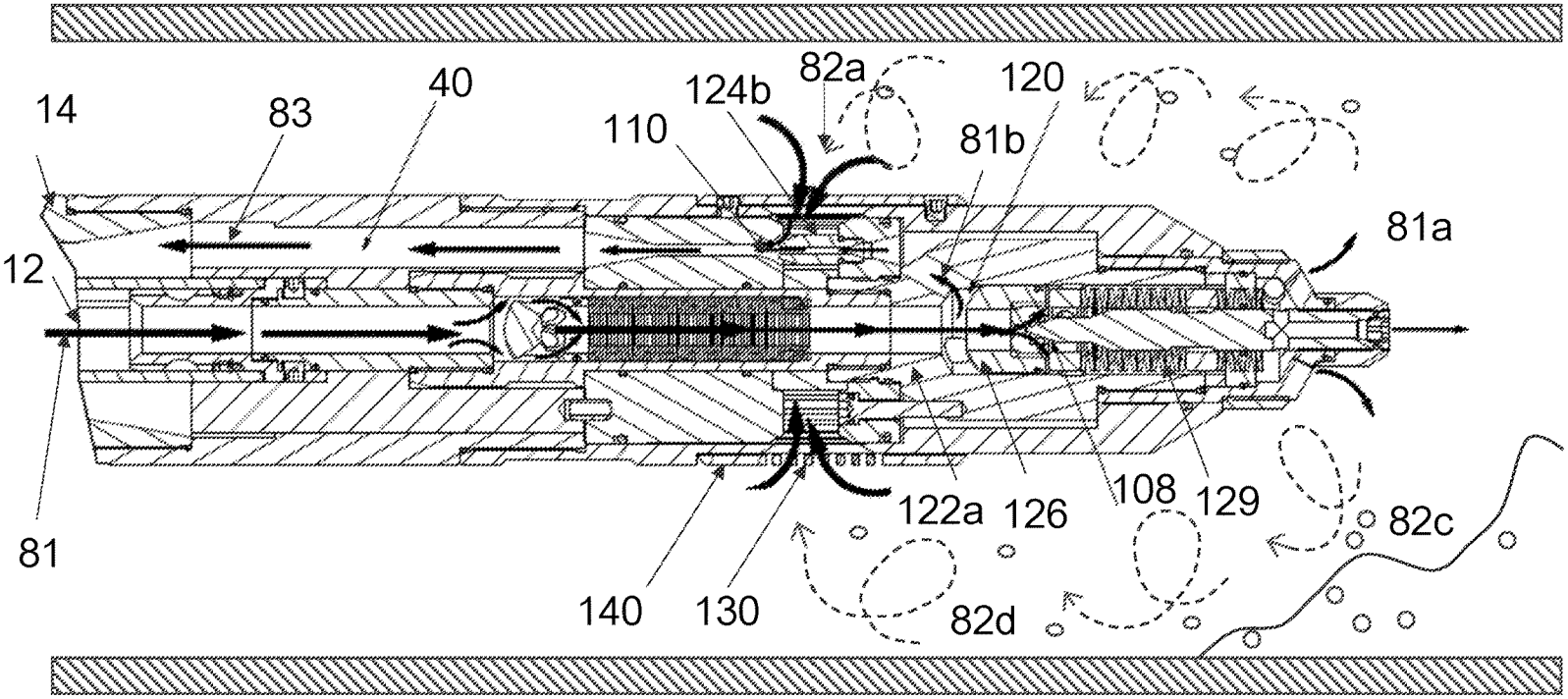
FIG. 24 is the longitudinal cross section of the preferred embodiment of the present invention shown in FIG. 22, illustrating the "Well Jet and Vacuum" operation mode.
Figure 25:
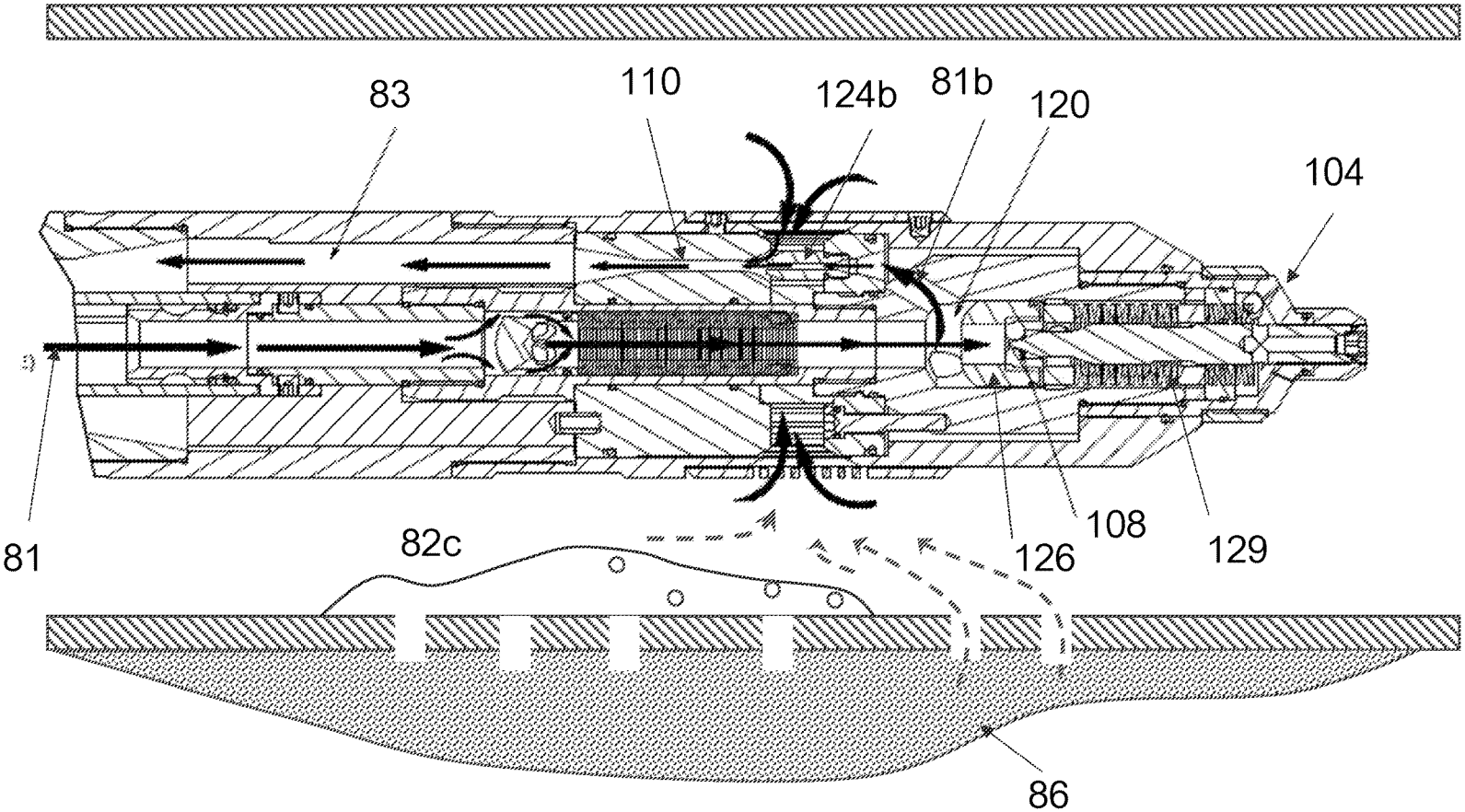
FIG. 25 is the longitudinal cross section of the preferred embodiment of the present invention shown in FIG. 22, illustrating the "Well Vacuum" operation mode.

FIG. 23-25 shows the additional modes of operation of the tool. When the drive fluid 81 pressure is intentionally raised from the BP level to a level higher to the pressure P1 which is the minimum pressure required to overcome the resistance or closing force of the fluid column hold valve 118, the fluid passes through said valve then through internal fluid conduit formed by the central hole of the venturi plate transition component 40 and venturi plate assembly 110, and finally reach the control valve assembly 120. The control valve assembly 120 for this particular embodiment acts as a normally closed valve (referring the term "closed" only to the extended position of the springs, not to the flow condition through the internal orifice on the piston), three position-two way pressure sensitive valve, which allows the drive fluid 81 to take any of the two ways depending on its pressure level. Each one of the three positions of the control valve assembly 120 will correspond to a different operation mode of the tool. As described earlier in FIGS. 9 and 10 for this particular embodiment of the invention the control valve assembly 120 comprises the sliding jet nozzle shift dart 126 loaded by the disc springs 129 and a relief valve assembly 122, but other embodiments of the present invention could comprise normally open valve or even an array of a different number of valves in order to achieve the desired three position—two ways of the flow. For this embodiment the three positions of the control valve 120 corresponds to: (a) the most extended length of the disc springs 129, (b) the most comprised length of the disc springs 129, and (c) an intermediate position between positions (a) and (b).

FIG. 23 shows the so called "Well Jet" operation mode of this embodiment of the tool, which occurs when the pressure of the drive fluid 81 is in the LP range, meaning higher than pressure P1, but lower to the pressure P2, which is the pressure required to overcome the force of disc springs 129, being called this pressure range LP range. While the drive fluid 81 is on LP range, the control valve 120 remains on its (a) position, meaning that the disc spring 129 is extended at its most possible length causing the outer side of the jet nozzle shift dart 126 to set against the inner walls of the venturi inlet sub 122*a*, preventing the drive fluid 81 to flow onto the venturi jetting nozzles 124*b*, allowing it only to flow through the inner opening of the jet nozzle shift dart 126 towards the Vortex Generating Wash nozzle 104 to become the jet fluid 81*a* coming out of the tool, with sufficient force to unplug or refine obstructive material exemplified by sand bridges, mud, wax, soft scale, congregate, and the like in the wellbore that would otherwise prevent further passage of the tool into the wellbore. The fluid jet produces spiral like currents 82*a* with the wellbore fluid, which makes the disintegration and fluidization of sediments 82*c* more effective than the single jet impact. The power fluid 81*a* being projected outward from the Vortex Generating Wash nozzle 104 follows a 360 degree spray pattern, producing an egressing fluid flow that is irregularly pulsatile and intermittent, producing a flow vortex, a swirl flow, and a helical flow of highly pressurized high-speed irrigation fluid which rotation can be controlled by reconfiguring the components within the wash nozzle assemblies, or by modulating the fluid flow pressure through the wash nozzle assemblies. Additionally, the intermittent, pulsing high-speed fluid flow directed over the entire circumference allows the tube or wellbore to be thoroughly cleaned at lower fluid pressures and fluid flow rates than static jet wash nozzles FIG. 24 describes the so called "Well Jet and Vacuum" operation mode of this embodiment of the tool, which occurs when the pressure of drive fluid 81 is raised intentionally to a level higher than P2 pressure, but lower than the pressure P3, the later defined as the pressure that produces the full compression of the disc spring 129. At this pressure range, the control valve 120 is set to position (c), resulting in the jet nozzle shift dart 126 being separated from the inner walls of the venturi inlet sub 122*a*, allowing the drive fluid to flow in two different paths, one through the inner opening of the jet nozzle shift dart 126 because of the gap with the tip of the shutoff valve stem 108, which leads the drive fluid to be jet as fluid 81*a* as in the case of the operation mode described in FIG. 23, and a second flow path which conducts the drive fluid up to the venturi jet nozzle 124*b*, what is indicated by arrow 81*b*. As the drive fluid 81*b* passes through the venturi plate assembly 110, the low pressure caused by the principles of the jet pump makes the wellbore fluid "WF" 82*a* carrying the removed solids to enter the device through slot openings of the slotted suction head housing 130, which is covered by the suction screen 140 in order to prevent larger particles suspended in wellbore fluid 82*a* from entering the tool, causing the obstruction of conduits and venturi throats. The combination of the suctioned wellbore fluid 82*a* with the suspended solids 82*c* on it, plus the injected drive fluid 81*b* passing through the venturi assembly 46 and the venturi transition plate 40 is called the returning fluid RF 83, and it is sent to the surface through the annular space between the outer coil tubing 14 and the inner coil tubing 12 because of the increase of pressure due to the conversion of the kinetic energy of the return fluid 83 into static pressure at the venturi diffuser section, as in any typical downhole jet pump systems.

The simultaneous action of the drive fluid jet 81*a* generated by the Vortex Generating Wash Nozzle assembly 100, and the suction generated by the venturi effect increases the spiral currents solids 82*c* of the tool, which enhances tool effectiveness for the removal of sediments and debris obstructing the wellbore.

FIG. 25 shows the fourth operation mode so called "Vacuum Only Mode" of the same embodiment of the invention as shown on the preceding FIGS. 22 to 24. To achieve this operation mode, the drive fluid pressure 81 is raised up to a level equal or higher than P3 pressure called the pressure range HP, which causes the control valve assembly 120 being set to position (b), consisting on the compression of the disc springs 129 to its minimum possible length when the tip of the jet shutoff valve stem 108 gets inserted into the inner orifice of the traveling jet nozzle shift dart 126 attached to the end of the disc springs 129. Once occurs the occlusion of the internal bore of the jet nozzle shift dart 126 by the seating of the jet shutoff valve stem 108 against it, the drive fluid 81 (called 81*b* once it is diverted to flow towards venturi conduits) can only flow into the venturi nozzles 124*b* and the venturi assembly 110 as described for FIG. 23, being the flow into the Vortex Generating Wash Nozzle 104 completely blocked which ceases the spiral jet of drive fluid out of the tool. The return fluid 83 is composed by the power fluid 81 and the well bore fluids suctioned by the tool.

The "Vacuum Only" is effective in the reactivation of the production zones of an oil well by the joint effect of removing the sediments 82*c* blocking the flow to the wellbore as by the stimulation of the reservoir 86 by the pressure differential created by the venturi effect. The present embodiment of the tool disclosed has an advantage regarding some existing tools because of the location of the multiple circumferential jet pump venturis which ensures an uniform 360 degree pressure differential around the tool regardless of the orientation of the tool.

The results obtained by the tool operating in the theoretical four operating modes described above (FIG. 22-25) may produce different effects and be better suited to different specific works, depending on the direction of movement of the tool. For this reason, we distinguish six different practical operating modes (called PO Modes) of the tool being: Reset Mode or PO mode A, which can be performed in any direction or stationary; Jet Only Downwards or PO mode B, Jet Only Upwards or PO mode C, Vacuum and Jet Downwards or PO mode D; Vacuum and Jet Upwards or PO mode E; Vacuum Only or PO mode F, which can be performed in any direction or stationary.

The present document discloses not only the tool hardware and its embodiments but also the methods how it operates to successfully perform the different works it's been designed for. These methods are obtained from physical testing of the tool on real operations and consist on specific sequences of some of the six practical operation modes described above, for the main works on the area of wellbore solid obstruction removal and well stimulation, and they are:

(Method 1) Tool Surface Calibration. Fluid power is pumped to the tool to adjust the spring force opening of the three valves at determined pressures, being the PO modes sequence PO mode A, PO mode B or C, PO mode D or E, PO mode F. The pressure levels stablished consider the hydrostatic pressure of both power fluid and wellbore fluid, type of each of those fluids, flow pressure loss, target depth, kind and composition of sediments to remove, and tool hardware configuration among other factors.

(Method 2) CleanOut. Run the tool downwards in PO mode A until a depth above target depth, switch to PO mode D at the lower pressure in range LP, increasing pressure within LP range as closing to target depth. Continuous evaluation of the return fluid indicates when target depth is reached because of change of composition. Once target depth is reached increase pressure over P3 to switch to PO mode F moving downwards and upwards. When pulling the tool out of the hole switch to PO mode E and after PO mode A upwards until reaching surface.

(Method 3) Blockage Removal. Run the tool down into the hole in PO mode B, and once passed the suspected target depth switch into PO mode C upwards to ensure blockage disintegration. Run again in PO mode D downwards at the lower pressure in range MP as far above target depth and increasing up to the highest pressure within MP range until reaching target depth, then switch to PO mode F downwards and upwards up to a depth far above target depth. Then switch to PO mode E and finally to PO mode A up to the surface.

(Method 4) Well Activation. Run the tool into the hole with PO mode D downwards to the target depth, then increase pressure to switch to PO mode F remaining at the same depth while evaluating the return fluid at surface. Once formation fluids are found at a certain rate in the return fluid, tool can be pulled in PO mode E upwards and after to PO mode A up to surface.

The tool operation modes are not limited to the methods disclosed in this document, but those are the ones describing the main operation the tool has been designed for, mainly referred to oil/gas wells.

Figure 26A:
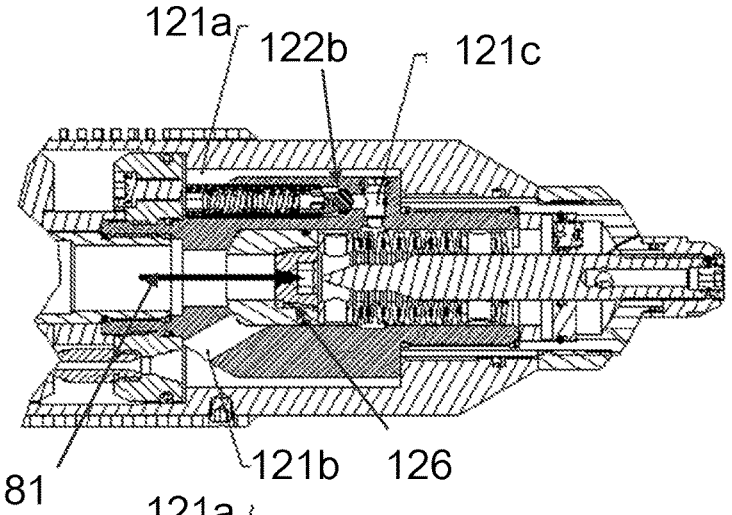
FIG. 26*a* is a partial longitudinal section view of the preferred embodiment of the present invention when the control valve piston is on its closed position in "Jet Only" operation mode, showing the relief valve components closed.
Figure 26B:
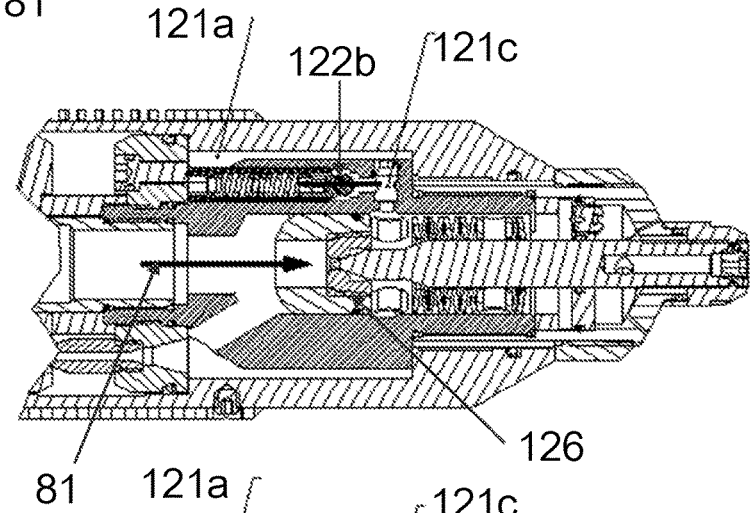
FIG. 26*b* is a partial longitudinal section view of the preferred embodiment of the present invention when the control valve piston is shifted to its fully opened position in "Vacuum Only" operation mode, showing the relief valve components opened during transition.
Figure 26C:
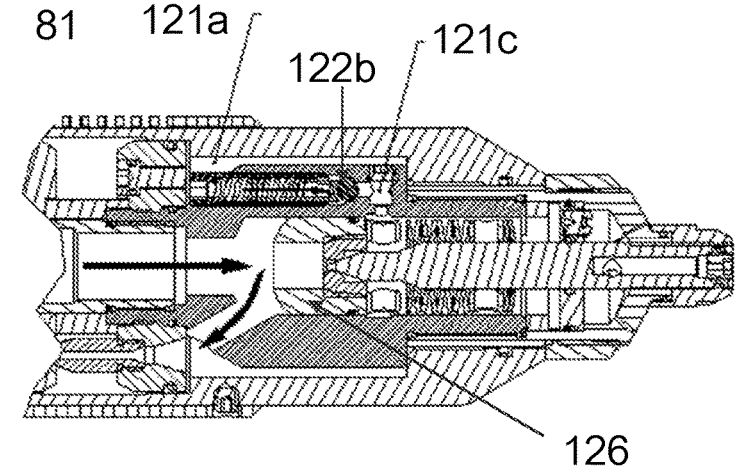
FIG. 26*c* is a partial longitudinal section view of the preferred embodiment of the present invention when the control valve piston is shifted to its fully opened position in "Vacuum Only" operation mode, showing the relief valve components closed after transition.
Figure 27:
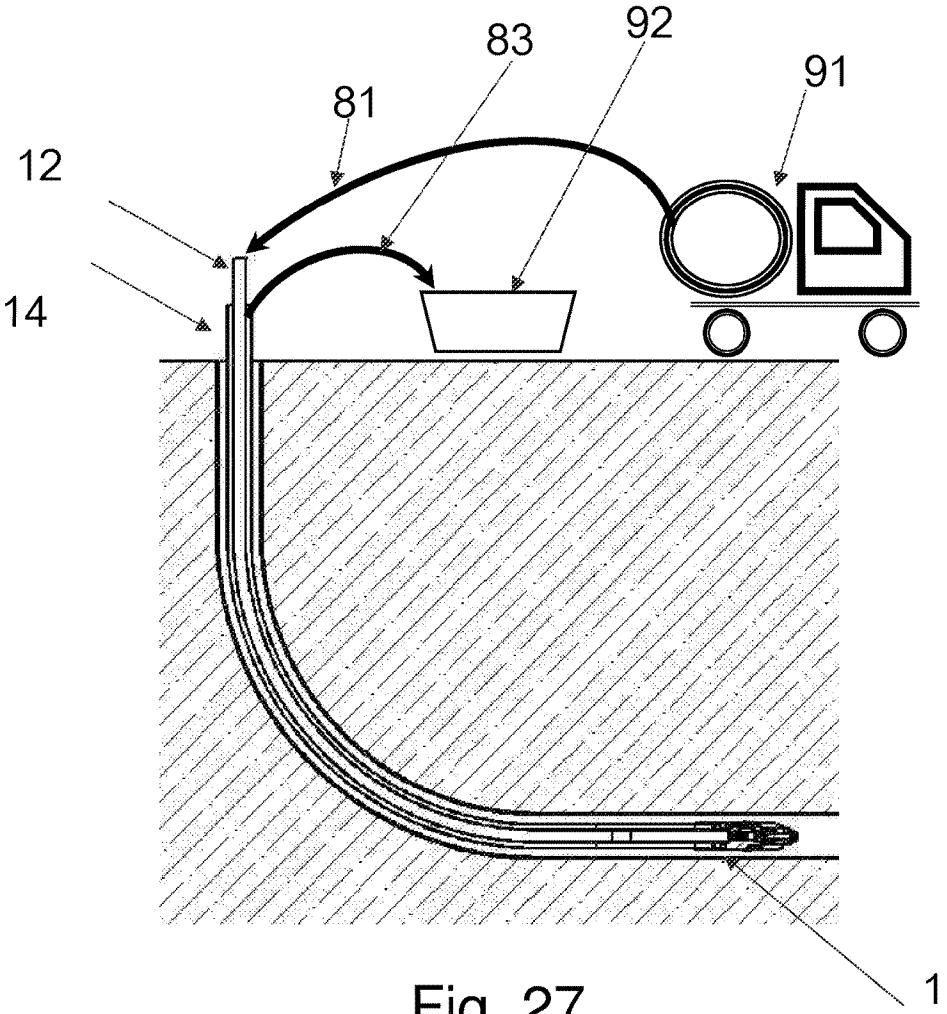
FIG. 27 is a scheme of a typical concentric coil tubing cleanout operation with the coiled tubing spiral venturi tool placed in the wellbore.

To accomplish one of the objectives of the present invention regarding the optimization of the overall operation time of the tool, it is provided a relief valve associated to the control valve (as shown in FIG. 10) which main purpose is to reduce the stabilization time of the tool when the switch between operation modes occurs. FIGS. 26*a*, 26*b* and 26*c* describe the function of the relief valve on the preferred embodiment of the tool which consists on relieving the pressure of the Power Fluid trapped on the conduits of the venturi nozzle and the ones on the jet nozzle which are at both sides of the control valve Jet nozzle shift dart 126. FIG. 26*a* describes the jet nozzle shift dart 126 in the seated position (Jet Only Operation mode position) closing the venturi nozzle conduits 121*a* and 121*b*, which makes that the pressure on those conduits be equal to the hydrostatic pressure of the wellbore fluid, lower than the one on the jetting nozzle conduits 121*c* at the power fluid 81 pressure. In that position, the relief valve ball 122*b* is in closed position (right most position in FIG. 26*a*), which maintains the pressure difference between the two conduits aiding the control valve shift dart to stay closed. FIG. 26*b* shows the control valve shift dart 126 movement (right most position in FIG. 26*b*) when the power fluid 81 has been increased to switch into Venturi Only mode. As the Power Fluid now pressurizes the venturi nozzle conduits, the relief valve ball 122*b* opens (moving leftwards in FIG. 26*b*) because of the pressure difference between the remaining pressure of power fluid on the jetting nozzle conduits 121*c* which is higher than the now lower pressure in the venturi conduits 121*a* because of venturi effect. The high pressure on the jetting nozzle conduits 121*c* oppose to stabilize the position of the shift dart 126, so when relief valve ball 122*b* moves allowing communication between the venturi conduits 121*a* and the jetting nozzle conduits 121*c*, the pressure on the latest is reduced, which makes to stabilize position of shift dart 126 (because of the higher pressure on the upstream side of it) and makes the relief valve ball 122*b* spring to overcome the force generated by the pressure difference between the two conduits, all of this described on FIG. 26*c*. By the effect of the relief valve the time it takes the piston to settle in "Venturi Only Mode" position is lower, reducing the total time of operation FIG. 27 shows a typical concentric coil tubing cleanout operation in an oil/gas well using the invention herein disclosed. The tool 1 is attached to the concentric coil tubing 12 and 14 and located into the well section where the plugins and obstructions are located. The drive fluid 81 is pumped downhole through the inner coil tubing 12, being pressurized by the hydraulic pressure surface unit 91. When the tool operates in either of the two vacuum modes, the return fluid 83 is pumped to the surface by the jet pump effect through the outer coil tubing 14, and it discharges at the surface into a collector tank 92, where it is processed, filtered to remove the solid from the well bore, and conditioned to be recirculated and pumped down again.

While the preferred embodiment and various alternative embodiments of the invention have been disclosed and described in detail herein, it may be apparent to those skilled in the art that various changes in form and detail may be made therein without departing from the spirit and scope thereof.

We claim:

1. A device for use with concentric coiled tubing, the concentric coiled tubing comprising inner and outer tubes with an annular conduit formed therebetween, the device being configured to remove solids from inside an external conduit using a pressurized power fluid, the concentric coiled tubing being connected to coiled tubing equipment positioned outside of the external conduit, the device comprising:

a sealing connection assembly configured to be mechanically and hydraulically coupled to the concentric coiled tubing;

a hydraulic control subsystem comprising at least one power fluid connection element and at least one control valve assembly, the at least one power fluid connection element being configured to receive the pressurized power fluid from the inner tube of the concentric coiled tubing and provide the pressurized power fluid to the at least one control valve assembly when a pressure level of the pressurized power fluid overcomes a flow resistance, the at least one control valve assembly comprising at least one pressure biased multi-position valve each comprising a moveable element;

a suction head subsystem comprising at least one jet pump assembly, the at least one jet pump assembly comprising a plurality of venturi located around a central opening, the plurality of venturi communicating with at least one cavity positioned outside the device, and an outlet of each of the plurality of venturi communicating with the annular conduit formed between the inner and outer tubes of the concentric coiled tubing; and a jetting nozzle subsystem comprising at least one vortex generating wash nozzle assembly, wherein when the pressure level of the pressurized power fluid overcomes the flow resistance of the at least one power fluid connection element, the pressurized power fluid contacts the moveable element of each of the at least one pressure biased multi-position valve and sets the moveable element's position based on the pressure level of the pressurized power fluid, the at least one control valve assembly directing the pressurized power fluid to flow to the jetting nozzle subsystem when the moveable element is in a first position, the at least one control valve assembly directing the pressurized power fluid to flow to the suction head subsystem when the moveable element is in a second position, the at least one control valve assembly directing the pressurized power fluid to flow to both the jetting nozzle subsystem and the suction head subsystem simultaneously when the moveable element is in a third position, a pulsating jet spray of the pressurized power fluid exiting from the device to remove the solids from inside the external conduit when the at least one control valve assembly directs the pressurized power fluid to flow to the jetting nozzle subsystem, fluids in the external conduit being suctioned therefrom and pumped through the annular conduit formed between the inner and outer tubes of the concentric coiled tubing when the at least one control valve assembly directs the pressurized power fluid to flow to the suction head subsystem.

2. The device of claim 1, further comprising:

a relief valve configured to assist movement of the moveable element of each of the at least one pressure biased multi-position valve when the moveable element is moved by the pressurized power fluid.

3. The device of claim 2, wherein the moveable element of each the of the at least one pressure biased multi-position valve is an exchangeable piston configured to allow all of the pressurized power fluid to flow through the at least one vortex generating wash nozzle assembly when the moveable element is in the first position.

4. The device of claim 2, wherein the moveable element of each of the at least one pressure biased multi-position valve has an internal bore configured to allow the pressurized power fluid to flow therethrough.

5. The device of claim 1, further comprising:

a filter screen configured to filter the fluids suctioned from the external conduit.

6. The device of claim 1, wherein the at least one power fluid connection element is a hold down valve assembly that is biased into a closed position when the pressure level of the pressurized power fluid is insufficient to overcome the flow resistance.

7. The device of claim 1, wherein the at least one power fluid connection element comprises an inline filter.

8. The device of claim 1, wherein the at least one power fluid connection element is a hold down valve assembly including an inline filter.

9. The device of claim 1, wherein the plurality of venturi are located around the central opening in a circular arrangement.

10. The device of claim 9, wherein each of the plurality of venturi is equal sized.

11. The device of claim 9, wherein the plurality of venturi are equally spaced apart.

12. The device of claim 9, wherein the plurality of venture each have an end portion with an orifice, the end portion having a non-conical internal shape.

13. The device of claim 1, further comprising:

a safety disconnect assembly configured to disconnect the device from the concentric coiled tubing.

14. The device of claim 1, wherein the suction head subsystem is allocated closer to the sealing connection assembly than the jetting nozzle subsystem.

15. The device of claim 1, wherein the hydraulic control subsystem, the suction head subsystem, and the jetting nozzle subsystem are connected by rigid interfaces not allowing relative movement between the hydraulic control subsystem, the suction head subsystem, and the jetting nozzle subsystem.

16. The device of claim 1, wherein the hydraulic control subsystem, the suction head subsystem, and the jetting nozzle subsystem are connected by flexible interfaces allowing relative movement between the hydraulic control subsystem, the suction head subsystem, and the jetting nozzle subsystem.

17. The device of claim 1, further comprising:

a venturi diffuser, the suction head subsystem comprising a first venturi plate transition component positioned downstream of the venturi diffuser.

18. The device of claim 17, further comprising:

at least one second venturi plate transition component configured to increase pressure energy conversion.

19. The device of claim 1, further comprising:

a pressure activated rupture device configured to remove a build up of solid material collected on an external surface of the device.

20. The device of claim 1, wherein each of the at least one vortex generating wash nozzle assembly comprises a bearing assembly configured to allow the vortex generating wash nozzle assembly to rotate.

21. The device of claim 1, wherein the fluids pumped through the annular conduit comprise at least a portion of the solids, and the device further comprises:

a tubular element configured to supply the pressurized power fluid to aid in pumping the fluids to a surface positioned outside the external conduit.

22. The device of claim 1, further comprising:

a mechanical connection configured to be connected to Indexing Tools, Data Recorder Tools, Drilling Tools, Debris Collection Tools, Junk Collection Tools, Sleeve Shifting Tools, or other tools used with the concentric coiled tubing.

23. The device of claim 1, wherein the device is capable of partial disassembly.

24. The device of claim 1, wherein each of the at least one pressure biased multi-position valve comprises at least one deformable spring, the pressurized power fluid moves the moveable element to the first, second, and third positions when the pressurized power fluid is at a different one of a plurality of pressure levels, and the plurality of pressure levels at which the moveable element of each of the at least one pressure biased multi-position valve shifts its position are modified by mechanical manipulation of the pressure biased multi-position valve and/or replacement of the at least one deformable spring of the pressure biased multi-position valve.

25. The device of claim 1 configured to be placed in a non-oilfield conduit.

* * * * *